US012552565B2

(12) United States Patent
Biondi et al.

(10) Patent No.: US 12,552,565 B2
(45) Date of Patent: Feb. 17, 2026

(54) PACKAGING UNIT FOR PACKAGING ARTICLES IN BOXES AND METHOD FOR PACKAGING ARTICLES IN BOXES

(71) Applicant: R.A JONES & CO., Covington, KY (US)

(72) Inventors: Andrea Biondi, Bologna (IT); Luca Cavazza, Bologna (IT); Ivanoe Bertuzzi, Bologna (IT); Enrico Campagnoli, Bologna (IT); Marco Ghini, Bologna (IT); Luca Borderi, Bologna (IT)

(73) Assignee: R.A JONES & CO.

( * ) Notice: Subject to any disclaimer, the term of this patent is extended or adjusted under 35 U.S.C. 154(b) by 87 days.

(21) Appl. No.: 18/724,465

(22) PCT Filed: Dec. 27, 2022

(86) PCT No.: PCT/IB2022/062817
§ 371 (c)(1),
(2) Date: Jun. 26, 2024

(87) PCT Pub. No.: WO2023/126837
PCT Pub. Date: Jul. 6, 2023

(65) Prior Publication Data

US 2025/0066052 A1 Feb. 27, 2025

(30) Foreign Application Priority Data

Dec. 29, 2021 (IT) ..... 102021000032993

(51) Int. Cl.

| | |
|---|---|
| ***B65B 5/02*** | (2006.01) |
| ***B65B 35/10*** | (2006.01) |
| ***B65B 43/12*** | (2006.01) |
| ***B65B 43/26*** | (2006.01) |
| ***B65B 43/28*** | (2006.01) |

(52) U.S. Cl.
CPC ..... *B65B 5/024* (2013.01); *B65B 35/10* (2013.01); *B65B 43/126* (2013.01); *B65B 43/265* (2013.01); *B65B 43/285* (2013.01)

(58) Field of Classification Search
CPC ..... B65B 11/004; B65B 11/28; B65B 35/10; B65B 43/126; B65B 43/265; B65B 43/285; B65B 49/08; B65B 49/14; B65B 5/024
See application file for complete search history.

(56) References Cited

U.S. PATENT DOCUMENTS 1,875,986 A 9/1932 Bronander
2,109,505 A * 3/1938 Rue ..... B65B 49/08 53/157

(Continued)

FOREIGN PATENT DOCUMENTS

EP 3628604 A1 4/2020

OTHER PUBLICATIONS

International Search Report and Written Opinion issued for International PCT Application No. PCT/IB2022/062817 filed on Dec. 27, 2022 on behalf of R.A Jones & Co. Mail Date: May 8, 2023. 11 pages.

*Primary Examiner* — Himchan Song
(74) *Attorney, Agent, or Firm* — Steinfl + Bruno LLP

(57) ABSTRACT

A packaging unit for packaging articles in boxes includes a mandrel, a movement device, a feeding device, a first abutment surface, and a retaining device. The mandrel is configured to accommodate at least one of said articles inside it. The movement device is configured to move said mandrel along a movement trajectory. The feeding device is configured to feed at least one blank along a feeding trajectory which intersects said movement trajectory towards said mandrel to form one of said boxes around said mandrel. The first abutment surface is defined on said (Continued)

mandrel as the surface of said mandrel intended to abut said blank when positioned in said movement trajectory. The retaining device is displaceable between an operating position in which said retaining device approaches said first abutment surface to retain said blank against said first abutment surface and a non-operating position in which said retaining device is spaced apart from said first abutment surface.

17 Claims, 8 Drawing Sheets

(56) References Cited

U.S. PATENT DOCUMENTS 3,482,372 A * 12/1969 Hottendorf ..... B65B 5/024 53/74
4,548,019 A * 10/1985 Kruse ..... B65B 19/24 53/170
4,852,335 A 8/1989 Focke et al.
4,947,617 A * 8/1990 Focke ..... B65B 11/28 53/575
4,962,628 A * 10/1990 Boldrini ..... B65B 11/28 53/462
4,999,970 A * 3/1991 Bamrungbhuet ..... B65B 19/225 53/225
5,822,954 A * 10/1998 Osti ..... B65B 11/004 53/586
8,075,466 B2 * 12/2011 Cavallari ..... B31B 50/00 493/51
2004/0261368 A1 12/2004 Focke et al.
2006/0037290 A1 * 2/2006 Smith ..... B65B 43/10 53/566
2020/0346798 A1 * 11/2020 Lambertz ..... B65B 65/04

* cited by examiner

PACKAGING UNIT FOR PACKAGING ARTICLES IN BOXES AND METHOD FOR PACKAGING ARTICLES IN BOXES

CROSS REFERENCE TO RELATED APPLICATIONS

The present application is the U.S. national stage of International Application No. PCT/IB2022/062817 filed on Dec. 27, 2022, which, in turn, claims priority to Italian Patent Application No. 102021000032993 filed on Dec. 29, 2021.

The present invention concerns a unit and a method for packaging articles in boxes, particularly suitable for packaging articles in accordance with a process in which it is provided for forming the box around the article to be packaged, known in the art as "wrap-around" process.

The content of the following patent applications, filed on the same date by the same Applicant, is considered incorporated herein in their entirety:

- Italian patent application No. 102021000032948 entitled "Packaging unit for packaging articles in boxes and method for packaging articles in boxes" filed on 29 Dec. 2021;
- Italian patent application No. 102021000032993 entitled "Packaging unit for packaging articles in boxes and method for packaging articles in boxes" filed on 29 Dec. 2021;
- Italian patent application No. 102021000032984 entitled "Packaging unit for packaging articles in boxes and method for packaging articles in boxes" filed on 29 Dec. 2021;
- Italian patent application No. 102021000032915 entitled "Unit and method for packaging articles in boxes" filed on 29 Dec. 2021;
- Italian patent application No. 102021000033011 entitled "Packaging unit for packaging articles in boxes and method for packaging articles in boxes" filed on 29 Dec. 2021;
- Italian patent application No. 102021000033008 entitled "Packaging unit for packaging articles in boxes and method for packaging articles in boxes" filed on 29 Dec. 2021;
- Italian patent application No. 102021000033017 entitled "Packaging unit for packaging articles in boxes and method for packaging articles in boxes" filed on 29 Dec. 2021;
- Italian patent application No. 102021000032933 entitled "Packaging device for packaging articles in boxes and relative packaging method" filed on 29 Dec. 2021;
- Italian patent application No. 102022000011693 entitled "Packaging device for packaging articles in boxes and relative packaging method" filed on 1 Jun. 2022;

The present invention finds a preferred, although not exclusive, application in the field of packaging in boxes articles with variable geometry and which are relatively delicate, such as for example bags of corn flakes, a sector to which reference may be made below without losing generality.

In particular, in the relevant technical field, it is known to package articles into a box according to some distinct manners.

A first manner provides a first step of forming a box, which is open at least at one end thereof, the subsequent insertion of the article to be packaged into the open box and, then, the closure of the open end.

In a second manner, the box is formed by wrapping a blank around a mandrel which is made of rigid material, for example of metal, and which contains the article to be packaged. This manner provides that the blank is wrapped around the mandrel so as to form a box that is closed laterally but open at one end thereof, from which the mandrel is then extracted leaving the article inside the newly formed box. Also in this case, the open end can be conveniently closed, so that the package thus made can be sent to the final steps of packaging and shipment to the points of sale. In this manner, a folding device is provided which folds the blank around the mandrel. The folding device may comprise a plurality of folding elements each intended to form a distinct face of the box.

In this description as well as in the accompanying claims, certain terms and expressions are deemed to have, unless otherwise expressly indicated, the meaning expressed in the following definitions.

The term "article" means any product that can be packaged in boxes. The articles can have a predetermined geometric shape or they can have a variable geometry. Preferably, the articles are food and confectionery articles, in bulk or contained inside bags or other types of wrapping, such as for example cereal bags or coffee capsules or other infusion beverages, single chocolates (wrapped or not), candies, pouches containing solid, liquid or semi-solid food products; in addition, articles of the ceramic industry, absorbent articles for hygienic use, articles of the tobacco industry, articles of the cosmetic industry, articles of the pharmaceutical industry, articles of the "personal & home care" industry.

By "packaging" one or more articles in a box, it is meant the fact of obtaining a box containing said one or more articles. Such packaging can be obtained by inserting one or more articles into an already formed box or, preferably, it can be obtained by forming a box around the one or more articles to be contained.

By "mandrel" it is meant a container capable, on the one hand, of accommodating and supporting the article to be packaged and, on the other hand, of providing an effective abutment for folding the blank when wrapped around it.

For this purpose, it should be noted that accommodating and supporting the article does not in itself imply that the article must be entirely accommodated inside the mandrel or completely supported by it, but it is sufficient for it to be accommodated in the moment in which the blank is wrapped around the mandrel. Likewise, it should be noted that also the abutment of the blank does not imply in itself that the blank is abutted for its entire surface by the mandrel, but it is sufficient for it to be abutted to an extent such as to allow the correct folding necessary for the formation of the box.

The mandrel can be formed by a single component, or by a plurality of units. The latter can be directly connected to each other or they can be "separate units", with this expression meaning distinct mandrel portions (units), not directly connected to each other, and preferably movable independently of each other.

A mandrel is "composed" of the separate units when the latter are mutually positioned in such a way as to correctly fulfil the functions of the mandrel indicated above, that is of accommodating and of supporting the article to be packaged and to provide an effective abutment for the folding of the blank.

On the contrary, a mandrel is "decomposed" in its separate units when it is no longer able to correctly perform its functions of accommodating and supporting the article and of abutting the blank.

By "blank" it is meant a shaped sheet of appropriate material and thickness which is suitable to be wrapped by folding around a mandrel to form a box. Preferably, the blank is made of cardboard. Preferably, the blank has a thickness of at least 0.2 mm, more preferably less than 4 mm. In a greatly preferred manner, the blank has a thickness comprised between 0.25 mm and 1.6 mm, more preferably between 0.3 mm and 1 mm, even more preferably between 0.4 and 0.8 mm.

By "flap" it is meant a region of the blank that allows fixing the blank to another region in such a way as to form an at least partially closed box, preferably around a mandrel. The flap is an outer panel of the blank, i.e. a panel comprising an edge of the blank. Some non-limiting examples of such a fixing are gluing, stapling and jointing by means of interlocking elements or elements with laces and hooks (Velcro®).

In particular, the fixing to form an at least partially closed box takes place by at least partially overlapping two flaps of the blank, an inner flap and an outer flap.

Specifically, it is intended to indicate with "outer flap" the flap that, overlapped on the inner flap, is located outside the at least partially closed box, whereas it is intended to indicate with "inner flap" the flap that, overlapped on the outer flap, is located between it and the inside of the at least partially closed box.

A "folding line" of a blank is a predefined line around which two blank panels are provided for rotating relative to each other so as to fold the blank, preferably around the mandrel. The folding line can be a virtual, albeit predefined line. The folding line is preferably defined by a line of weakness obtained on the blank, such as for example a crease, or an incision or a plurality of aligned holes.

In general terms, a first element "abuts" a second element when the first element touches the second element and is able to at least partially oppose a relative displacement of the first element against the second element.

In particular, the blank is "abutted" by a component of the packaging unit, such as for example a mandrel or a folding device, when the component, in order to fold the blank around the folding line, abuts the blank at a distance from the folding line which is less than 10 times the thickness of the blank, preferably less than 5 times the thickness of the blank. In some versions, the abutment provides for the contact between the blank and the component of the packaging unit.

In view of the thickness of the blanks that are used in the sector of packaging articles in boxes, a folding line may be considered to be "abutted" by a component of the packaging unit when the component, in order to fold the blank around the folding line, abuts the blank at a distance from the folding line which is less than 5 mm, preferably less than 3 mm.

It should be noted that the abutment of the blank does not imply in itself that the blank is abutted for its entire surface by a component of the packaging unit, such as for example the mandrel or the folding device, but it is sufficient for it to be abutted to an extent such as to allow the correct folding necessary for the formation of the box.

By "box" it is meant any container suitable for containing a plurality of articles for the purpose of their packaging, which can be made starting from a blank by folding around a mandrel and subsequent fixing at edges or panels thereof. Preferably, the box has at least one closed contour section, more preferably it is closed laterally around the mandrel while the longitudinal ends are kept open.

The term "trajectory" refers to the linear path travelled by an object, for example a mandrel or a blank, during its displacement. The trajectory is represented by an oriented line. A "stroke" or a "portion" of a trajectory are also represented by oriented lines.

When a trajectory, or a stroke thereof, is comprised within a plane, that plane is defined as the "advancement plane" of the object.

With reference to a particular trajectory, a first element has an "advanced position" or is positioned "downstream" with respect to a second element along the oriented line identified by such trajectory, when the first element is in a position subsequent to the position of the second element. In a completely similar way, a "backward position" and a position "upstream" of a first element with respect to a second element are also defined, when the first element is in a position preceding the position of the second element.

It is understood in the present document that two objects, for example a mandrel and a folding device, are in whole or in part "overlapped" with respect to a trajectory, when their respective orthogonal projections are in whole or in part overlapped on a plane containing the trajectory.

A vector quantity, for example the speed, is defined by a "modulus" and by a "direction", herein intended to include also the sense of direction, and can be represented by an oriented segment of length equal to the "modulus" and oriented in the sense of direction indicated by the "direction".

The Applicant has preliminarily observed that the wrap-around type packaging process briefly illustrated above allows to obtain significant advantages in terms of flexibility compared to the packaging process with insertion of the article in the preformed box. In fact, in the wrap-around type packaging process, the times required to switch from one format to another or to bring new formats into production are significantly reduced.

The Applicant has however observed that in such a packaging process when carried out at high speeds, for example to increase the production capacity of the apparatus, the blanks may not be correctly wrapped around the mandrel obtaining boxes with non-precise or regular shape, in particular when the blanks have considerable dimensions.

The Applicant has further observed that in the wrap-around type packaging process one of the critical steps in the process for packaging the articles in boxes is the positioning of the blank between the folding device and the mandrel. The correct positioning of the blank between the folding device and the mandrel is in fact necessary to obtain a correctly formed box, that is, in which the blank is correctly folded along the folding lines and the flaps of the blank are correctly glued to close the box.

For this purpose, the Applicant has observed that the blank is fed via a suitable feeding device to the packaging unit in a planar configuration. The blank is interposed between the mandrel and the folding device and the step of folding the blank around the mandrel is thus carried out by abutting opposed surfaces of the blank respectively with an abutment surface of the mandrel and with the folding device of the packaging unit.

The Applicant has pointed out that an incorrect positioning of the blank implies that cannot be obtained a box having precise shape and that the blank is not correctly folded along the folding lines.

The Applicant has verified that even minimal displacements of the blank with respect to the desired position between the mandrel and the folding device can negatively affect the quality of the box obtained.

However, the Applicant has found that a correct positioning of the blank is a feature that is hardly compatible with the high production speeds required in the packaging processes.

The Applicant has therefore imagined using blank feeding devices configured to precisely position the blank between the mandrel and the folding device.

However, the Applicant has verified that the possibility of using such feeding systems was limited by the required productivity.

In particular, the Applicant has verified that such a solution would not have been implementable in the known packaging apparatuses.

The Applicant has also hypothesized to slow down the packaging process to allow a more precise positioning of the blank between the mandrel and the folding device. However, this solution has not proved to be implementable due to the required productivity limits.

The Applicant has therefore realised that in order to limit the possibility of incorrect positioning of the blanks between the folding device and the mandrel, it was necessary to effectively abut the blank during its wrapping around the mandrel.

The Applicant has therefore perceived that it was advantageous to retain the blank against the mandrel before folding the blank around the mandrel itself.

The Applicant has therefore realised that the retention of the blank on the mandrel could be obtained optimally by using a movable retaining device.

On the basis of this intuition, the Applicant has finally found that a method and a packaging unit for packaging articles in boxes which provides for using a retaining device displaceable between an operating position in which the retaining device is approached to the first abutment surface of the mandrel to retain the blank against the first abutment surface and a non-operating position in which the retaining device is spaced apart from the first abutment surface surprisingly allow to fold the blank in the desired position and to obtain a high folding precision even at high operating speeds.

In a first aspect thereof, therefore, the present invention is directed to a packaging unit for packaging articles in boxes.

Preferably, said unit comprises a mandrel configured to accommodate one of said articles inside it.

Preferably, said unit comprises a movement device configured to move the mandrel along a movement trajectory.

Preferably, said packaging unit comprises a feeding device configured to feed a blank along a feeding path which intersects said movement path towards said mandrel in order to form one of said boxes around said mandrel.

Preferably, said packaging unit comprises a first abutment surface defined on the mandrel as the surface of the mandrel intended to be the first to abut the blank as first when the blank is positioned in the movement trajectory.

Preferably, said packaging unit comprises a retaining device displaceable between an operating position in which the retaining device is approached to the first abutment surface of the mandrel to retain the blank against the first abutment surface and a non-operating position in which the retaining device is spaced apart from the first abutment surface.

In a second aspect thereof the present invention concerns a method for packaging articles in boxes.

Preferably, said method comprises depositing at least one of said articles in a mandrel.

Preferably, said method comprises moving the mandrel along a movement trajectory.

Preferably, said method comprises displacing a blank by means of a feeding device and positioning the blank along the movement trajectory of the mandrel in an advanced position with respect to the mandrel.

Preferably, said method comprises abutting the blank with a first abutment surface of the mandrel.

Preferably, said method comprises retaining the blank against the first abutment surface with a retaining device.

Preferably, said method comprises the step of decoupling the blank from the feeding device.

Preferably, said method comprises the step of displacing the blank with the mandrel along said movement trajectory while the blank is retained against the first abutment surface.

Thanks to these features, the method and the packaging unit according to the invention allow to effectively fold a blank around a mandrel ensuring a high folding precision without, moreover, penalising the production speed. Thanks to these features it is therefore possible to obtain boxes of high quality level and at the same time maintain a high production capacity.

By abutting the blank by means of a movable retaining device it is possible to avoid unwanted displacements of the blank with respect to the mandrel before folding that would affect the quality of the box obtained while at the same time avoiding slowing down the production speed. It is in fact not necessary to keep the blank in the feeding device for a long time. On the contrary, it is possible to limit as much as possible the time in which the blank is retained by the feeding device.

This, in addition to ensuring high productivity, avoids issues resulting from a possible interference of the feeding device with the mandrel or with the folding device.

Furthermore, by using a movable retaining element, no interferences are generated between the mandrel and the retaining device when the latter is not in use. This avoids unwanted complications to the packaging unit and to the packaging method of the invention. It is therefore not necessary to adapt the mandrel and/or the feeding device to the presence of the retaining device.

A precise folding of the blank along the folding lines provided therein is thus obtained.

In a third aspect thereof, therefore, the present invention is directed to a packaging unit for packaging articles in boxes.

Preferably, said packaging unit comprises a packaging equipment and a movement device which is configured to move the packaging equipment along a movement trajectory.

Preferably the packaging equipment comprises a mandrel configured to accommodate one of said articles inside it.

Preferably, said mandrel comprises a first abutment surface defined on the mandrel as the surface of the mandrel intended to abut a blank as first when the blank is positioned in the movement trajectory.

Preferably, such a mandrel comprises a folding surface defined on the mandrel as the surface of the mandrel that is opposed in the direction of the movement trajectory to the first abutment surface.

Preferably, said packaging equipment comprises a retaining device displaceable with respect to the mandrel between an operating position in which the retaining device is approached to the first abutment surface of the mandrel to retain the blank against the first abutment surface and a non-operating position in which the retaining device is spaced apart from the first abutment surface.

Preferably said packaging equipment comprises a closing device displaceable with respect to the mandrel between a pressure position in which the closing device is approached to the folding surface of the mandrel to press an outer flap of the blank on an inner flap of the blank when the blank is wrapped at least partially on the mandrel and against a folding surface of said mandrel, and a rest position in which the closing device is spaced apart from the folding surface.

Thanks to this aspect of the invention it is possible to obtain a compact equipment that is able to effectively fold a blank around the mandrel. The retaining device and the closing device are displaceable integrally with the mandrel by means of the movement device along the movement trajectory and are at the same time displaceable with respect to the mandrel to respectively retain and fold the blank around the mandrel to perform the required operations.

This increases the precision of the folding. The displacements of the retaining device and of the folding device with respect to the mandrel can be adjusted more precisely. Furthermore, the possibility of unwanted interferences between mandrel, retaining device and folding device are reduced at the same time. By displacing the equipment along the movement trajectory it is possible to bring the equipment to interact with various devices provided along the movement trajectory.

The present solution, in at least one of the aforementioned aspects, may have at least one of the further preferred features set forth below.

Preferably, the packaging unit further comprises an actuation member configured to displace the retaining device along an actuation trajectory towards the operating position.

Preferably the actuation trajectory comprises a transverse stroke arranged transversely to the movement trajectory of the mandrel.

In this way the retaining device can be displaced with respect to the movement trajectory of the mandrel when not in use so as to avoid unwanted interferences with the mandrel.

Preferably, the actuation trajectory comprises a thrust stroke arranged parallel to the movement trajectory of the mandrel.

In this way the retaining device can be approached to the mandrel to retain the blank against the mandrel and moved away from the mandrel when it is not necessary to retain the blank against the mandrel.

Preferably, the actuation trajectory is curvilinear.

Preferably, the actuation trajectory comprises an arc of circumference. The curvilinear actuation trajectory is arranged so that a transverse stroke arranged transversely to the movement trajectory of the mandrel and a thrust stroke arranged parallel to the movement trajectory of the mandrel can be identified thereon.

Preferably the movement device is configured to move the mandrel along an advancement plane.

Preferably the actuation member is configured to displace the retaining device along an actuation trajectory having at least one stroke incident to the advancement plane of the mandrel.

Preferably the actuation trajectory comprises a thrust stroke incident to the advancement plane of the mandrel.

In one version, the transverse stroke of the actuation trajectory is preferably parallel to the advancement plane defined by the mandrel when moved along the movement trajectory. In other words, the actuation member is configured to move the retaining device along an advancement trajectory having a transverse stroke parallel to the advancement plane of the mandrel.

In an alternative version, the transverse stroke of the actuation trajectory is incident to the advancement plane defined by the mandrel when moved along the movement trajectory.

The actuation member is preferably configured to displace the retaining device along an advancement trajectory having a transverse stroke incident to the advancement plane of the mandrel.

In an alternative version, the transverse stroke of the actuation trajectory is perpendicular to the advancement plane defined by the mandrel when moved along the movement trajectory. In other words, the actuation member is configured to displace the retaining device along an advancement trajectory having a transverse stroke perpendicular to the advancement plane of the mandrel.

Preferably, the actuation member is configured to displace the retaining device along the thrust stroke of the actuation trajectory in the direction that is opposite with respect to the movement trajectory of the mandrel to displace the retaining device into the operating position.

In some embodiments, the movement device is configured to move the mandrel along a movement trajectory comprising a circular trajectory portion.

In some embodiments, the movement device is configured to move the equipment along a movement trajectory comprising a circular trajectory portion.

Preferably, the actuation member is configured to displace the retaining device along an actuation trajectory in which the transverse stroke of the actuation trajectory is arranged radially with respect to the movement trajectory of the mandrel.

Preferably, said packaging unit comprises a feeding device configured to feed a blank along a feeding path which intersects said movement trajectory towards said mandrel in order to form one of said boxes around said mandrel.

Preferably, the packaging unit comprises a packaging equipment and a movement device which is configured to move the equipment along a movement trajectory.

Preferably the packaging equipment comprises the mandrel configured to accommodate one of said articles inside it.

Preferably, the mandrel comprises a folding surface defined on the mandrel as the surface of the mandrel that is opposed in the movement trajectory with respect to the first abutment surface.

Preferably the folding surface is in a backward position along the advancement trajectory with respect to the first abutment surface.

Preferably, the packaging equipment comprises the retaining device.

Preferably the packaging equipment comprises the closing device.

Preferably the retaining device and the closing device are positioned on the equipment on opposite sides with respect to the mandrel of the direction of the movement trajectory. In this way, the retaining device and the closing device can interact with opposed surfaces of the mandrel without interfering with each other.

In one version, the feeding device is configured to move the blank along a feeding trajectory comprising at least one radial feeding stroke arranged radially with respect to the movement trajectory of the mandrel.

Preferably, the feeding device comprises one or more suction cups for retaining the blank by suction. In other versions, different feeding devices such as retaining grippers, belts or feeding belts can be provided to feed the blank to the mandrel.

Preferably the radial feeding stroke has a direction opposed to the actuation transverse stroke. In this way a particularly efficient packaging unit is obtained having limited overall dimensions and in which the possibilities of interference between the various parts are minimized.

The retaining device is preferably operatively associated with the movement device to carry the retaining device along the movement trajectory. In this way, the retaining device is carried together with the mandrel along the movement trajectory, despite being displaceable with respect to the mandrel.

Preferably, the retaining device comprises a lamina with a retaining surface with shape similar to the first abutment surface of the mandrel. Preferably, the retaining surface is shaped so as to couple with shape coupling with the first abutment surface in the operating position.

Preferably, the lamina has a length comprised between 50% and 100%, preferably 60-80%, in a greatly preferred manner between 65-75% of the length of the first abutment surface.

Preferably, the lamina has a length comprised between 50% and 100%, preferably 60-80%, in a greatly preferred manner between 65-75% of the length of the blank.

Preferably, the packaging unit comprises a displacement member for displacing the closing device with respect to the mandrel between a pressure position in which the closing device is approached to the folding surface of the mandrel to press an outer flap of the blank on an inner flap of the blank and against a folding surface of said mandrel, and a rest position in which the closing device is spaced apart from the folding surface.

The actuation member and the displacement member may be any mechanism capable of moving along a predefined path the retaining device between the operating position and the non-operating position and respectively and the closing device between the pressure position and the rest position and are represented by a conveyor driven by electric, mechanical, hydraulic or pneumatic motors or other similar systems capable of displacing the retaining device or the closing device along a trajectory. An example of such organs are robotic arms.

In some versions the retaining device comprises a support structure fixed to the operating member and a lamina hooked in an adjustable manner to the support structure. Preferably the retaining device further comprises at least one adjustment device for hooking in an adjustable manner the lamina to the support structure.

In this way it is possible to adjust the position of the lamina with respect to the support structure. It is therefore possible to improve the retaining action exerted by the retaining device.

The lamina is preferably displaceable with respect to the support structure along a direction transversal to the movement trajectory.

The lamina is preferably displaceable with respect to the support structure along a direction parallel to the movement trajectory.

The lamina is preferably displaceable with respect to the support structure along a direction transversal to the first abutment surface of the mandrel.

Preferably the adjustment device comprises a pair of adjustment elements.

Preferably such one or more adjustment elements are configured to adjust a misalignment between the first abutment surface of the mandrel and the retaining surface of the lamina.

Preferably such one or more adjustment elements are configured to compensate for a misalignment between the first abutment surface of the mandrel and the retaining surface of the lamina such that, in the operating position, the first abutment surface of the mandrel and the retaining surface of the lamina are parallel.

Preferably the retaining surface of the lamina is arranged parallel to the first abutment surface of the mandrel.

Thanks to the adjustment elements, the retaining element is automatically arranged parallel to the first abutment surface of the mandrel; in fact, the retaining element, if there is a misalignment between the first abutment surface of the mandrel and the retaining surface of the lamina, is able to self-adjust in such a way as to orient said retaining surface parallel to the first abutment surface of the mandrel thanks to the presence of said adjustment members, thereby avoiding or limiting the issues deriving from the misalignment of said surfaces. The adjustment mechanism exerts its function only when there is a misalignment between the first abutment surface of the mandrel and the at least one retaining surface of the lamina.

In some embodiments the first abutment surface of the mandrel and the retaining surface of the lamina are flat.

In some embodiments the adjustment elements comprise joints and/or elastically deformable elements.

Preferably said adjustment elements comprise elastically deformable elements, such as for example springs, spiral springs and gas springs, and/or cylinder-piston members and/or inserts of polymeric material.

In some preferred embodiments said elastically deformable elements comprise cylinder-piston members, preferably pneumatic cylinder-piston members.

In some embodiments the adjustment elements are at least two.

Advantageously, this makes it possible to compensate much more efficiently for any misalignments between the first abutment surface and the retaining surface of the lamina.

In a preferred embodiment, the adjustment elements are spaced apart along a longitudinal direction of the lamina.

It will be appreciated that this technical feature makes it possible to compensate efficiently for any misalignments between the two surfaces, in particular when the lamina has a longitudinal dimension particularly greater than the other dimensions, i.e. when the lamina has an elongated shape in the longitudinal direction.

Preferably the closing device and the retaining device are provided on the equipment on opposite sides with respect to the mandrel. In this way, the mandrel is interposed in the direction of the movement trajectory between the closing device and the retaining device. In this way the closing device and the retaining device can interact with different portions of the blank and abut the mandrel on opposed faces of the same. The possibility of unwanted interferences between such devices is therefore reduced. This also allows to facilitate the operations for forming the box.

Preferably the closing device is provided in a position further backward along the movement trajectory than the retaining device.

Preferably the closing device is positioned on the equipment in a position further backward along the movement trajectory than the retaining device.

Preferably said closing device comprises an abutment element movable with respect to the mandrel.

Preferably said abutment element is movable with respect to said mandrel between a rest position, in which the abutting element is in a remote position from the mandrel, and a pressing position, in which the abutting element is in a position such as to press the outer flap on the inner flap and against a folding surface of said mandrel.

Preferably said displacement member is configured to displace the contacting element between the rest position and the pressing position.

Preferably the abutment element comprises at least one contact surface intended to abut the mandrel, more preferably the abutment element comprises at least one contact surface intended to abut the mandrel at the folding surface.

Preferably the abutment element comprises one or more compensation members intended to allow an adjustment of the position of the contact surface of the abutment element with respect to the mandrel.

Preferably such one or more compensating elements are configured to compensate for a misalignment between the folding surface of the mandrel and the at least one contact surface of the abutment element.

Preferably such one or more compensating elements are configured to compensate for a misalignment between the folding surface of the mandrel and the at least one contact surface of the abutment element such that, in the pressure position, the folding surface of the mandrel and the at least one contact surface of the abutment element are parallel.

Preferably the at least one contact surface of the abutment element is arranged parallel to the folding surface of the mandrel.

Preferably the at least one contact surface of the abutment element is arranged parallel to the folding surface of the mandrel as a result of said pressing.

It will be appreciated that it is thus possible to obtain automatically that the abutment element is arranged parallel to the folding surface of the mandrel; in fact the abutment element, if there is a misalignment between the folding surface of the mandrel and the at least one contact surface of the abutment element itself, is able to self-adjust in such a way as to orient said contact surface parallel to the folding surface of the mandrel thanks to the presence of said compensating members, avoiding or limiting the issues deriving from the misalignment of said surfaces.

Of course this compensation mechanism exerts its function only when there is a misalignment between the folding surface of the mandrel and the at least one contact surface of the abutment element.

In some embodiments the folding surface of the mandrel and the at least one contact surface of the abutment element are flat.

In some embodiments the compensating elements comprise joints and/or elastically deformable elements.

This allows in a simple and effective way to compensate for any misalignment between the folding surface of the mandrel and the at least one contact surface.

Preferably said elastically deformable elements comprise springs, such as for example spiral springs and gas springs, and/or cylinder-piston members and/or inserts of polymeric material.

In some preferred embodiments said elastically deformable elements comprise cylinder-piston members, preferably pneumatic cylinder-piston members.

In some embodiments such cylinder-piston members are connected to a compressed air circuit so as to keep such at least one contact surface pressed on such overlapped outer flap and inner flap of the blank against the folding surface of the mandrel.

Preferably said cylinder-piston members are connected to a compressed air circuit so as to keep such at least one contact surface of the abutment element pressed on such overlapped outer flap and such inner flap of the blank against the folding surface of the mandrel with a predetermined pressure.

Preferably said joints are ball joints and/or hinges.

In some embodiments the compensating elements are at least two.

Advantageously, this makes it possible to compensate much more efficiently for any misalignments between the two surfaces.

In a preferred embodiment, the compensating elements are distributed along a longitudinal direction of the contacting element.

It will be appreciated that this technical feature makes it possible to efficiently compensate for any misalignments between the two surfaces in particular when the contacting element has a longitudinal dimension particularly greater than the other dimensions, i.e. when the contacting element has an elongated shape in the longitudinal direction.

In some embodiments the abutment element comprises a support element engaged to the displacement member and to at least one contact element, the at least one contact surface belonging to said at least one contact element and said one or more compensating elements being interposed between the support element and said at least one contact element. In this way the contact element is displaceable with respect to the support element by means of the compensating elements.

In some embodiments the compensating elements are positioned at the opposite end regions of said contact surface.

It will be appreciated that, on the basis of these characteristics, the abutment element presses the outer flap on the inner flap and against the folding surface of the mandrel in particular in the end regions of the flaps themselves, where it is usually more important that they are fixed on each other.

In a preferred embodiment, at least one of said two flaps bears an adhesive on an overlapping surface with the other flap.

In some embodiments, the adhesive is a glue.

In some embodiments, the displacement member is arranged to displace the abutment element with respect to the mandrel from the rest position, to a folding position and from the folding position to the pressure position along a folding trajectory. Preferably such a trajectory is straight.

In the folding position the inner flap is at least partially folded towards the folding surface of the mandrel; and the outer flap is folded on the inner flap and towards said folding surface of said mandrel. In the pressure position the outer flap and the inner flap are pressed against the folding surface of the mandrel.

Preferably such folding trajectory is incident to the advancement plane of the mandrel.

Preferably the folding trajectory comprises an approach stroke and a pressure stroke which are incident to each other.

Preferably at least one of the approach stroke and the pressure stroke is incident to the advancement plane of the mandrel.

In one embodiment, the abutment element in the pressure position presses the outer flap onto the inner flap against a folding surface of the mandrel and the straight trajectory is inclined by an angle comprised in the range from 10° to 60°, preferably from 20° to 45° with respect to said folding surface of the mandrel.

In some embodiments, said mandrel is formed by a single element.

In some embodiments, said mandrel is formed by several separate units. Preferably said units are displaceable with respect to each other so as to adjust the dimensions of an accommodation cavity for said article defined by said mandrel.

In some embodiments, said separate units are approached to one another to compose said mandrel.

In one embodiment said mandrel is formed by approaching said units until they come into direct contact with each other.

In an alternative embodiment, the mandrel is composed by approaching the separate units to each other without coming into direct contact.

In some versions, the packaging unit further comprises a folding device adapted to abut the blank and configured to cooperate with the mandrel to fold the blank around the mandrel when the blank is positioned between the mandrel and the folding device. The presence of the folding device allows to improve the performance of the packaging unit, reducing the times required for folding and optimising the shape of the box obtained.

In some versions, the folding device comprises a first folding element and a second folding element which are arranged to abut respectively a first panel and a second panel of the blank. This measure allows to improve the folding of the blank on the mandrel.

In the operating position, preferably, the retaining device is interposed between the first folding element and the second folding element to retain an intermediate panel of the blank interposed between the first panel and the second panel.

This optimises the step of folding the blank and its positioning before folding.

Preferably the first panel and the second panel of the blank are provided on opposite sides of the blank with respect to the advancement plane defined by the mandrel when it is moved along the movement trajectory. The first and second panels of the blank are intended to form two opposed faces of the box and are folded respectively on two opposed faces of the mandrel.

The lamina is preferably configured to couple to the intermediate panel of the blank.

In one version the packaging unit comprises an actuation device configured to displace the folding device along at least one folding stroke with an accompanying speed having at least one accompanying component with the same direction as the movement speed of the mandrel and modulus lower than the modulus of the movement speed in said folding stroke.

By moving the folding device in the same direction as the mandrel but at an accompanying speed having at least one accompanying component with the same direction as the movement speed of the mandrel and modulus lower than the modulus of the movement speed in the folding stroke, a relative motion is generated between the mandrel and the folding device that allows the blank to be progressively folded around the mandrel. At the same time, the impact force acting on the blank is reduced, avoiding or in any case drastically limiting the occurrence of any damages to the blanks and splashes of glue from the blank.

The presence of the retaining device allows that the blank can be folded more slowly around the mandrel without risking that the blank is displaced before being folded on the mandrel. This effect is achieved without the need to decrease the movement speed of the mandrel and, therefore, the productivity of the packaging unit.

Preferably, the difference between the modulus of the accompanying component and the modulus of the movement speed is comprised between about 0.05 m/s and about 2 m/s, preferably between about 0.1 m/s and about 1 m/s.

The difference between the modulus of the accompanying component and the modulus of the movement speed ensures that a relative motion is established between the mandrel and the folding device that allows the blank to be folded around the mandrel in the folding stroke.

Preferably the accompanying speed is parallel to the movement speed in the folding stroke.

In this way the folding device is moved, at least, in the folding stroke parallel to the mandrel. This version allows to maximize the folding precision of the blank around the mandrel.

Preferably, the movement speed is constant along the folding stroke.

It is possible to vary the accompanying speed of the folding device along the folding stroke and in particular the accompanying component, so as to vary the relative speed between mandrel and folding device.

Preferably, the accompanying speed is constant along the folding stroke.

It is possible to vary the movement speed of the mandrel along the folding stroke and so as to vary the relative speed between mandrel and folding device.

Preferably, both the movement speed and the accompanying speed are constant along the folding stroke. In this way it is possible to establish and maintain a constant difference between the modulus of the accompanying speed and the further modulus of the movement speed.

Preferably, the actuation device is configured to displace the folding device along a first portion of the folding stroke in which the folding device is spaced apart from the blank and a second portion of the folding stroke in which the folding device is in contact with the blank to fold said blank on said mandrel. The first portion and the second portion of the folding stroke are placed in succession in the folding stroke. Preferably, a point of abutment is defined on the folding stroke which separates the first portion from the second portion and in which the folding device abuts the blank.

The folding device is moved for the first portion of the folding stroke along the movement trajectory in a position spaced apart from the mandrel and, subsequently, along the second portion, in a position partially overlapped on the mandrel. Along the first portion of the folding stroke the distance between the folding device and the mandrel is progressively reduced up to the abutment position in which the folding device abuts the blank. In the first portion of the folding stroke the mandrel is in a backward position with respect to the folding device, and vice versa the folding device is in an advanced position with respect to the mandrel. Conversely, in the second portion of the folding stroke the mandrel and the folding device are at least partially overlapped with respect to the movement trajectory and the folding device is in contact with the blank.

It should be noted that when the folding device abuts the blank, the folding device is moved at an accompanying speed having at least one component that is concordant to the movement speed. This improves the contact between the blank and the folding device. Furthermore, since at the time of the contact between the mandrel and the folding device, the folding device and the mandrel are moving in a manner at least partially concordant, the contact between the mandrel, blank and the folding device is smooth, i.e. substantially free of sudden bumps.

It is therefore not necessary to slow down the mandrel before the contact between the blank and folding device. Unwanted slowdowns in the operation of the packaging unit are therefore avoided.

Preferably at least one folding element comprises a folding portion shaped to interact with the blank and a movement arm extending from the folding portion and coupled to the actuation device to actuate the folding element.

Preferably the actuation device is provided with a motor for actuating at least one of the first and second folding elements.

Preferably the actuation device is configured to actuate the first and second folding elements at the same speed, preferably in a synchronised manner.

Preferably, the first actuation element is configured to actuate the first folding element at a first accompanying speed and the second actuation element is configured to actuate the second folding element at a second accompanying speed that is different from said first accompanying speed.

Preferably the second actuation element is configured to actuate the second folding element at a second accompanying speed having the same direction as the first accompanying speed and a second modulus lower than a first modulus of the first accompanying speed.

Preferably the first folding element is arranged above the advancement plane of the mandrel and the second folding element is arranged below the advancement plane.

Preferably, at least one folding element between the first and second folding elements is fixed with respect to the folding trajectory.

Preferably the folding element arranged below the advancement plane is fixed with respect to the folding trajectory.

Preferably, the actuation device is configured to actuate the folding device along the folding stroke between a first position and a second position at the accompanying speed and to further actuate the folding device from the second position to the first position at a return speed in approach to the mandrel.

Preferably, the return speed has direction opposite to the movement speed.

In one version of the method of the present solution said retaining the blank against the first abutment surface is provided before decoupling the blank from the feeding device.

In one version of the method of the present solution said retaining the blank against the first abutment surface is provided after said abutting with a first abutment surface of the mandrel.

Preferably, the method comprises further abutting the blank with the folding device to fold the blank around the mandrel.

In one version of the method said retaining the blank against the first abutment surface is provided prior to said further abutting the blank with the folding device. Preferably said decoupling is provided after said further abutting.

In one embodiment, the method comprises displacing the retaining device between an operating position in which the retaining device retains the blank against the first abutment surface of the mandrel and a non-operating position in which the retaining device is spaced apart from the first abutment surface.

In one version of the method of the invention said displacing comprises displacing the retaining device along an actuation trajectory to bring it towards the operating position and further displacing the retaining device from the operating position to the non-operating position, said further displacing being provided after said further abutting.

Preferably the method comprises the step of providing a blank at least partially around a mandrel. Preferably said providing comprises providing a blank at least partially around a mandrel so as to form a partially closed box around said mandrel. Preferably said providing comprises providing a blank at least partially around a mandrel such that the blank has two flaps, an outer flap and an inner flap.

Preferably the outer flap is at least partially overlappable on the inner flap.

Preferably the two flaps are fixable on each other when pressed against each other.

Preferably the method comprises the step of providing an abutting element movable with respect to the mandrel between a rest position, in which the abutting element is in a far position far from with respect to the mandrel, and a pressure position, in which the abutting element is in a position such to press the outer flap.

Preferably in said pressing position the contacting element is in a position such to press the outer flap on the inner flap.

Preferably in said pressure position the abutting element is in a position such to press the outer flap on the inner flap and against an abutment surface of said mandrel.

Preferably the method comprises the step of at least partially folding the inner flap towards the mandrel.

Preferably the method comprises the step of at least partially folding the inner flap towards the folding surface of said mandrel.

Preferably the method comprises the step of folding the outer flap on the inner flap and against said folding surface of said mandrel.

Preferably said further abutting is provided before said folding said inner flap and said outer flap.

Preferably the method comprises the step of pressing the outer flap onto the inner flap and against said folding surface of said mandrel.

Preferably the method comprises the step of pressing the outer flap onto the inner flap and against said folding surface of said mandrel by displacing the abutting element into the pressure position.

Preferably said further abutting is provided before said pressing said inner flap and said outer flap.

Preferably the retaining surface of the lamina is arranged parallel to the first impact surface of the mandrel as a result of said pushing.

Preferably the retaining surface of the lamina is arranged parallel to the first impact surface of the mandrel as a result of said pushing, so as to exert a substantially uniform pressure on the blank.

In one version of the method of the invention said displacing comprises displacing the retaining device along a transverse stroke arranged transversely to the movement trajectory, translating the retaining device along a thrust stroke arranged parallel to the movement trajectory of the mandrel.

In a preferred embodiment the method of the invention comprises moving the mandrel along a movement trajectory comprising a circular trajectory portion.

In a preferred embodiment the method of the invention comprises displacing the retaining device along an actuation trajectory in which the transverse stroke is arranged radially with respect to the movement trajectory of the mandrel.

In a preferred embodiment the method of the invention comprises the step of carrying the retaining device along the movement trajectory.

In a preferred embodiment the method of the invention comprises the step of carrying the closing device along the movement trajectory.

In a preferred embodiment the method of the invention comprises feeding the blank along a feeding trajectory comprising at least one radial feeding stroke arranged radially with respect to the movement trajectory of the mandrel, preferably feeding along a radial feeding stroke (having direction that is opposed to the transverse stroke).

In some preferred embodiments the movement device is configured to displace the equipment along a circular trajectory.

Preferably the device comprises a carousel, more preferably carousel having a vertical axis.

In some embodiments the packaging unit comprises a plurality of equipments movable along the movement trajectory and a single folding device intended to interact in succession with the various equipment of the plurality of equipment.

Preferably each equipment is moved by the movement device so as to be brought at the folding device for folding the blank around the mandrel.

Preferably said retaining device and said closing device are actuated during the movement along the movement trajectory.

Preferably the outer flap and/or the inner flap are at least partially separated from the rest of the blank by a folding line.

Preferably the outer flap and/or the inner flap are folded along a folding line thereof.

In some embodiments, each folding line is formed by a crease or by an incision line or by a line of holes obtained on the blank.

In a preferred embodiment, at least one of said two flaps bears an adhesive on an overlapping surface with the other flap.

It should be noted that some steps of the method described above may be independent of the order of execution reported. In addition, some steps may be optional. In addition, some steps of the methods may be performed repetitively, or they may be performed in series or in parallel with other steps of the method.

The characteristics and advantages of the invention will become clearer from the detailed description of a preferred embodiment thereof, by way of non-limiting example, with reference to the appended drawings wherein.

Figure 13:
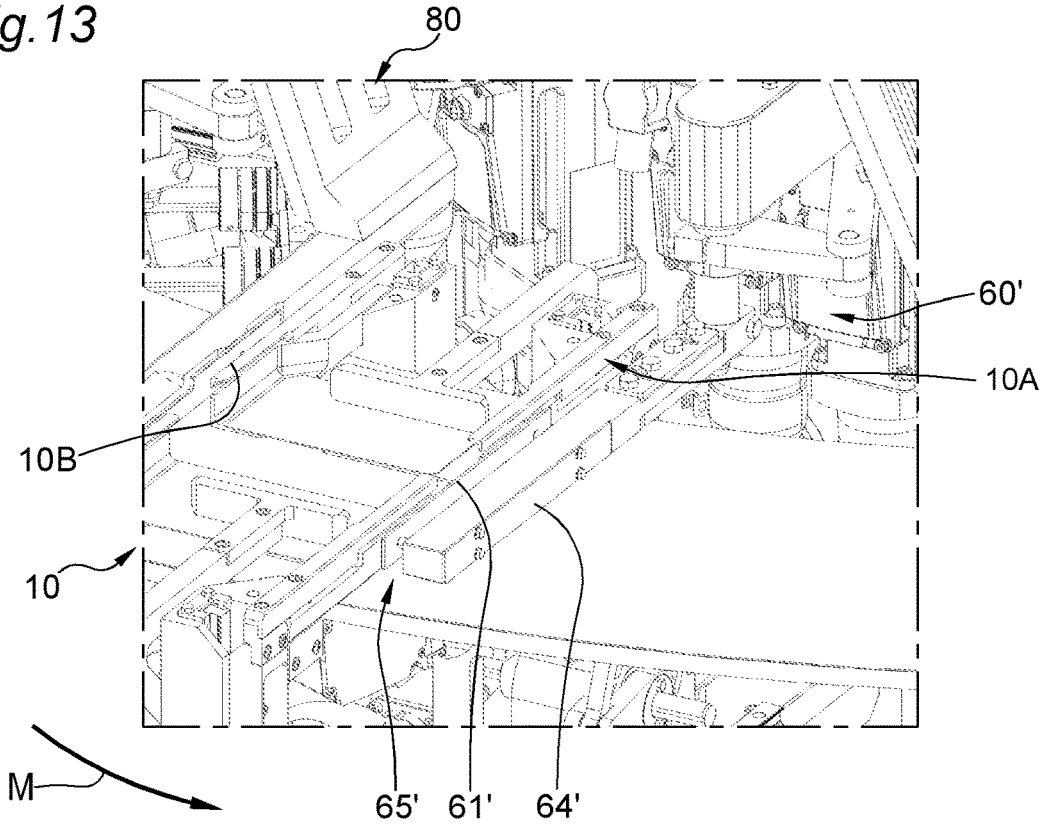
FIGS. 13 and 14 are truncated perspective views of a further version of a packaging unit according to the invention.
Figure 14:
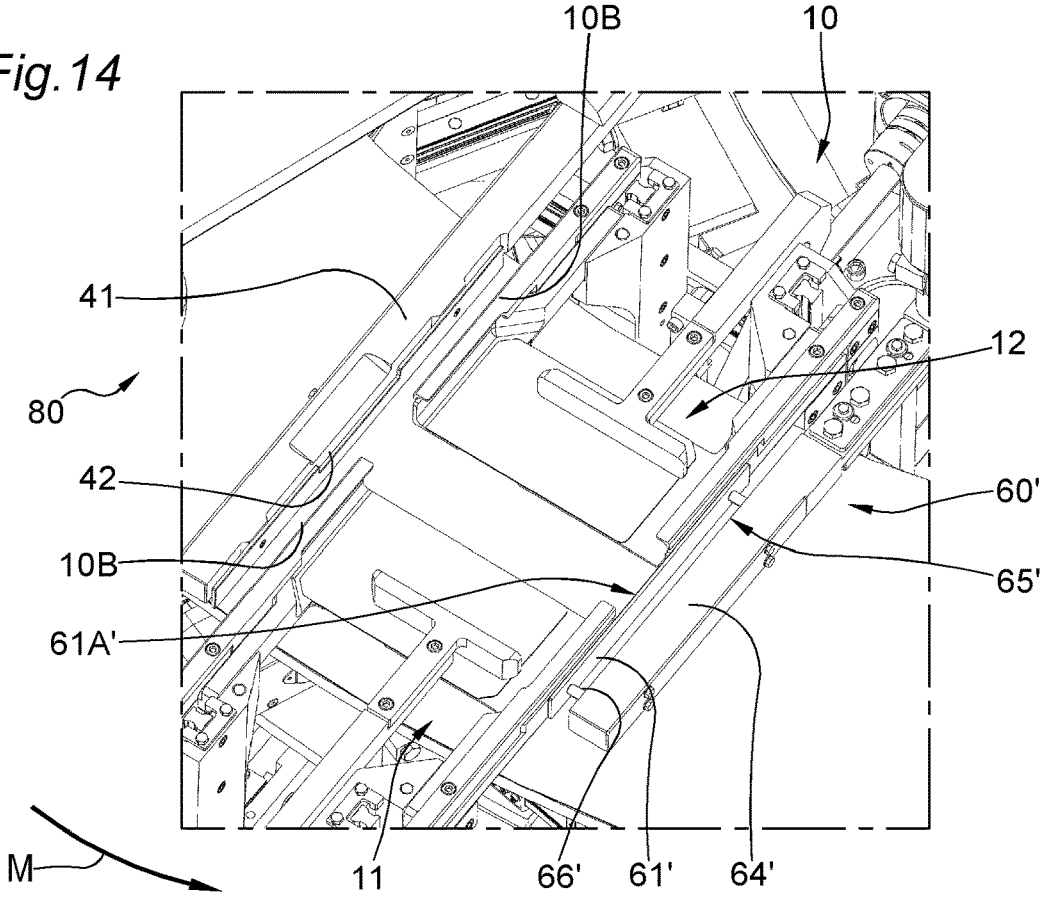
Figure 15:
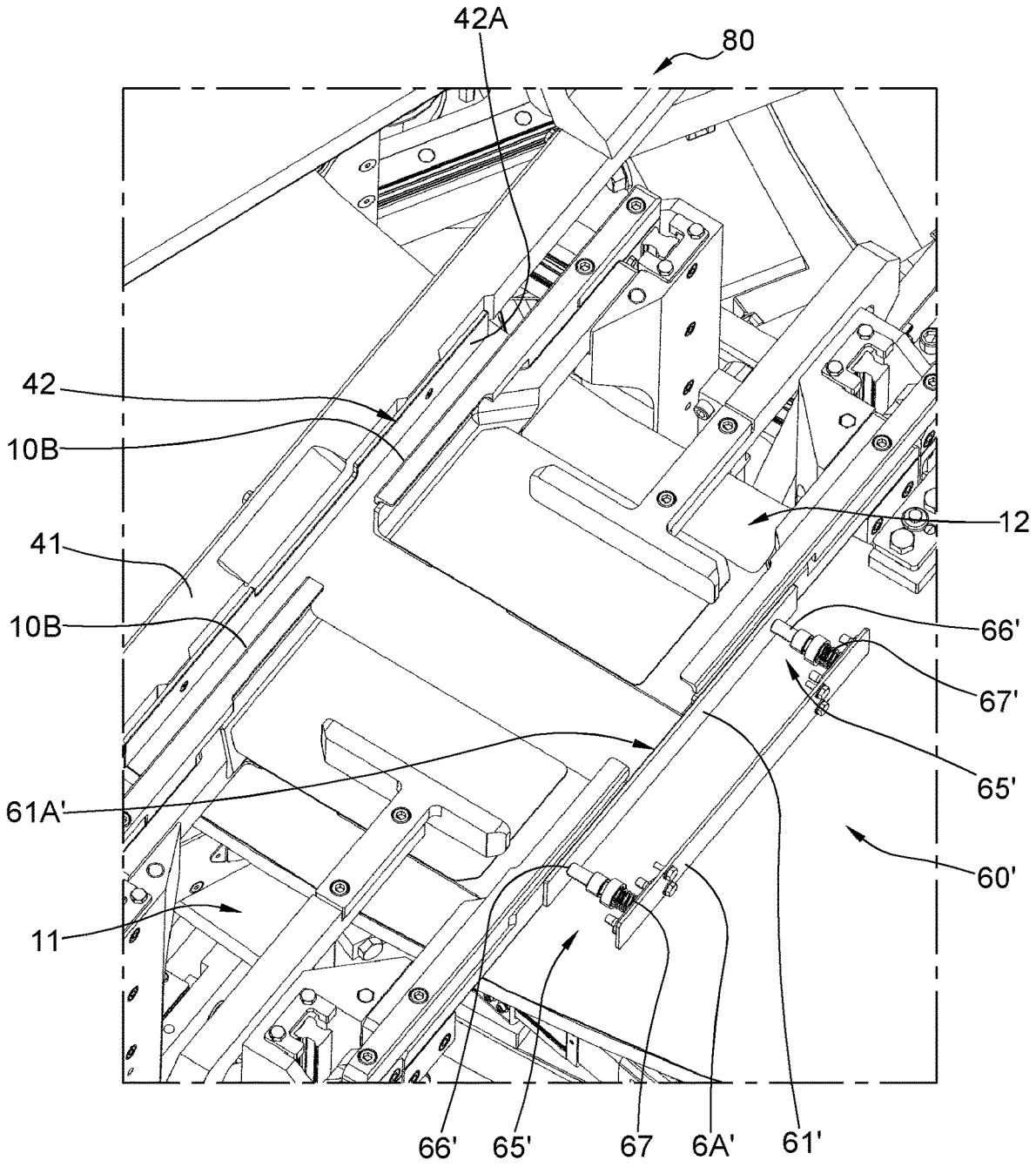
FIG. 15 is a perspective view of the packaging unit of FIG. 14 with some parts removed for clarity's sake.

In the accompanying figures, a packaging unit made in accordance with this solution is indicated as a whole with 100 and 100'. In particular, a first version of the packaging unit 100 is shown in FIGS. 1-12, while a further version of the packaging unit 100' is shown in FIGS. 13-15 which differs from that shown in FIGS. 1-12 solely in the configuration of the retaining device 60', the remaining parts being identical to those of the packaging unit 100. Therefore, with regard to the further packaging unit 100', only the retaining device 60' will be described below for brevity's sake, the parts of which corresponding to the retaining device 60 of FIGS. 1-12 will be indicated with the same numerical references followed by a superscript, for the remaining parts reference will be made to what will be described with reference to FIGS. 1-12 and these parts will be indicated with the same numerical references and not described in detail.

The packaging unit 100, 100' is of the "wrap-around" type, performing the packaging by wrapping a box around at least one article 1 to be packaged. In the present example the article 1, better visible in FIG. 3 or 4, consists of one or more flexible bags, filled with predetermined quantities of bulk products in the form of a discrete particulate consisting of granules and/or corn flakes and suitably sealed. The box 2 is formed by wrapping a blank 7 around a mandrel 10 bearing the article 1, as better clarified below.

The packaging unit 100, 100' is fed by a straight conveyor belt 101 on which the articles 1 to be packaged are conveyed, which in the present example consist of the bags described above, coming from the respective filling and sealing plant. The conveyor belt 101 transports the articles 1 to a first unloading end 102 at which the articles 1 are picked up by a transfer carousel 103 which is provided to pick up an article 1 to be packaged from the conveyor belt 101 and transfer it to the packaging unit 100, 100' in which the execution of a wrapping step of a box is provided for, as better clarified below.

The packaging unit 100, 100' comprises in its more general units a forming carousel 3 which is provided to receive the articles 1 from the transfer carousel 103 and to form a box 2, a feed carousel 5 for feeding blanks 7 to the forming carousel 3 and an outlet carousel 6, intended to pick up the boxes 2 formed by the forming carousel 3 and to deposit them on an evacuation belt 8 through which the boxes 2 are transported to subsequent processing units provided in the packaging unit 100, 100'.

Figure 1:
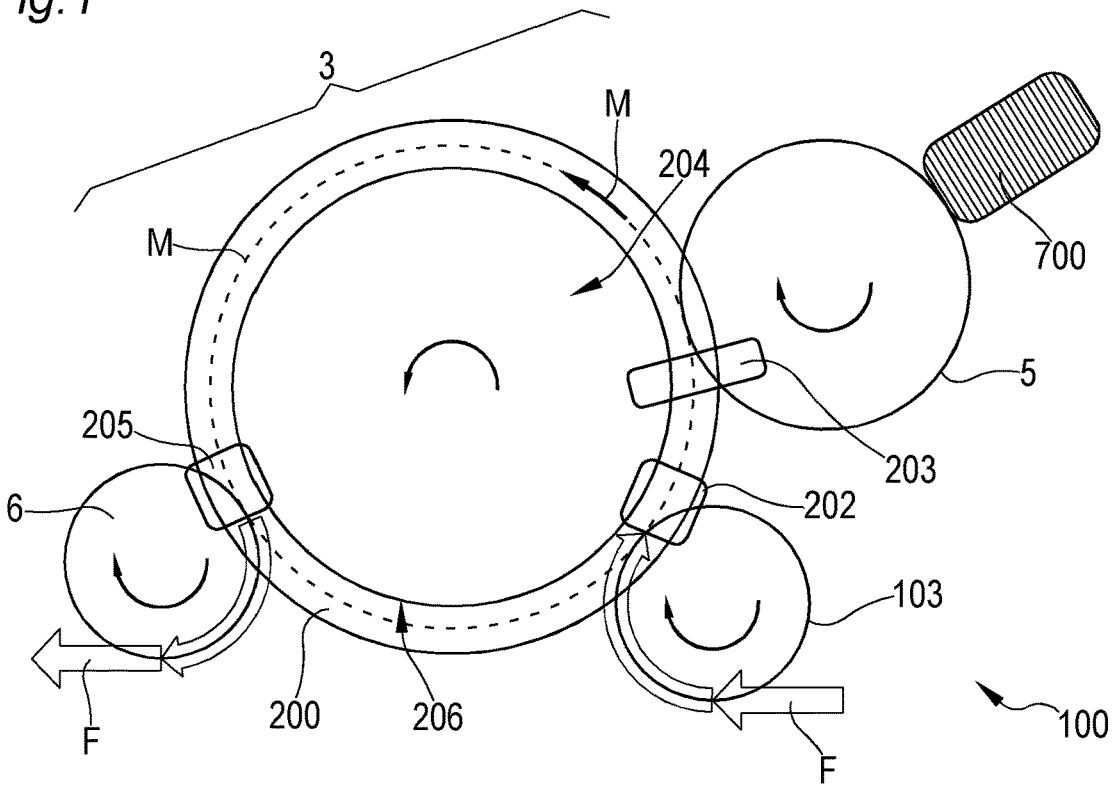
FIGS. 1 and 2 are two schematic plan views of an embodiment example of a packaging unit in accordance with the present solution.
Figure 2:
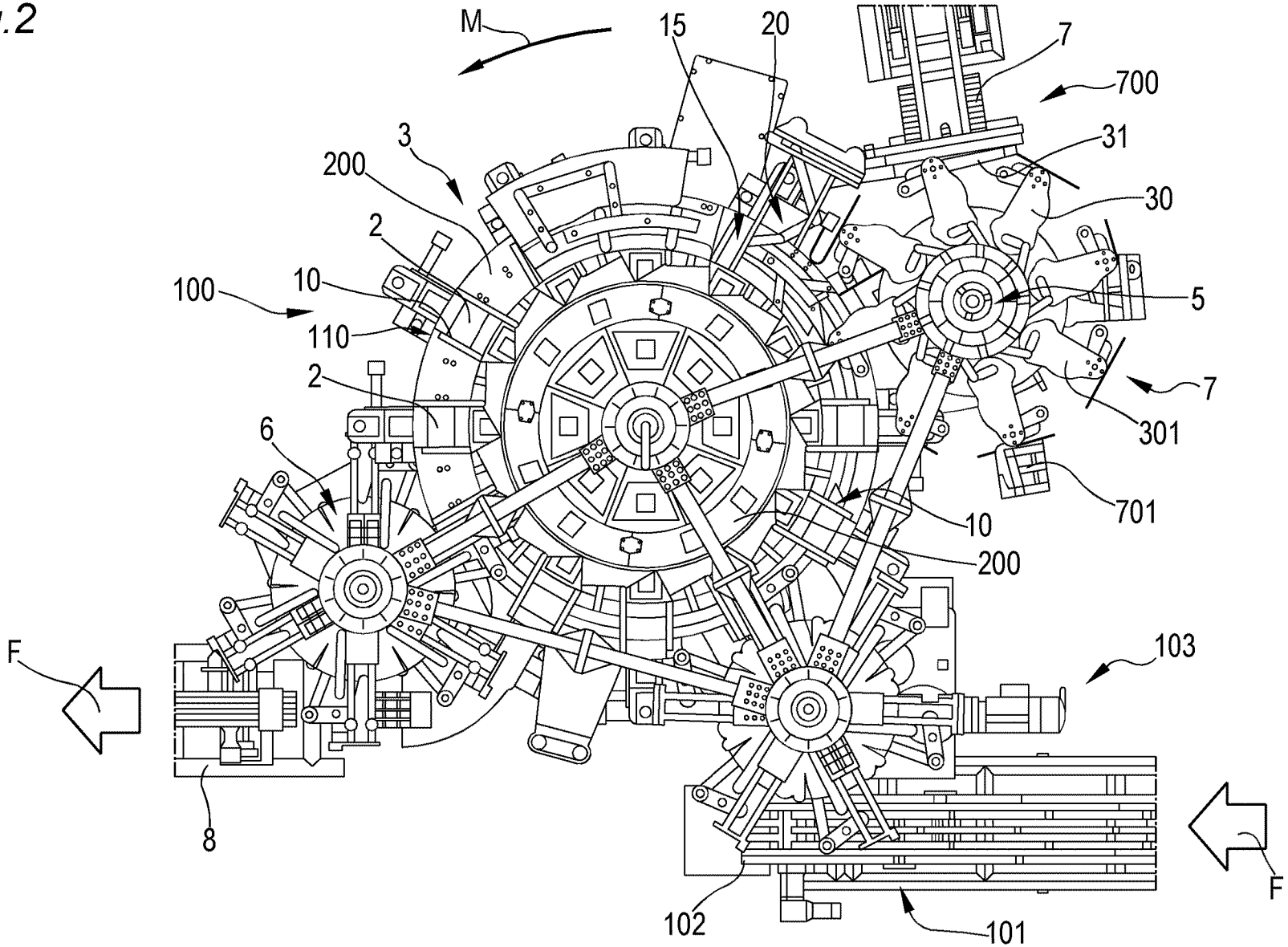
Figure 3:
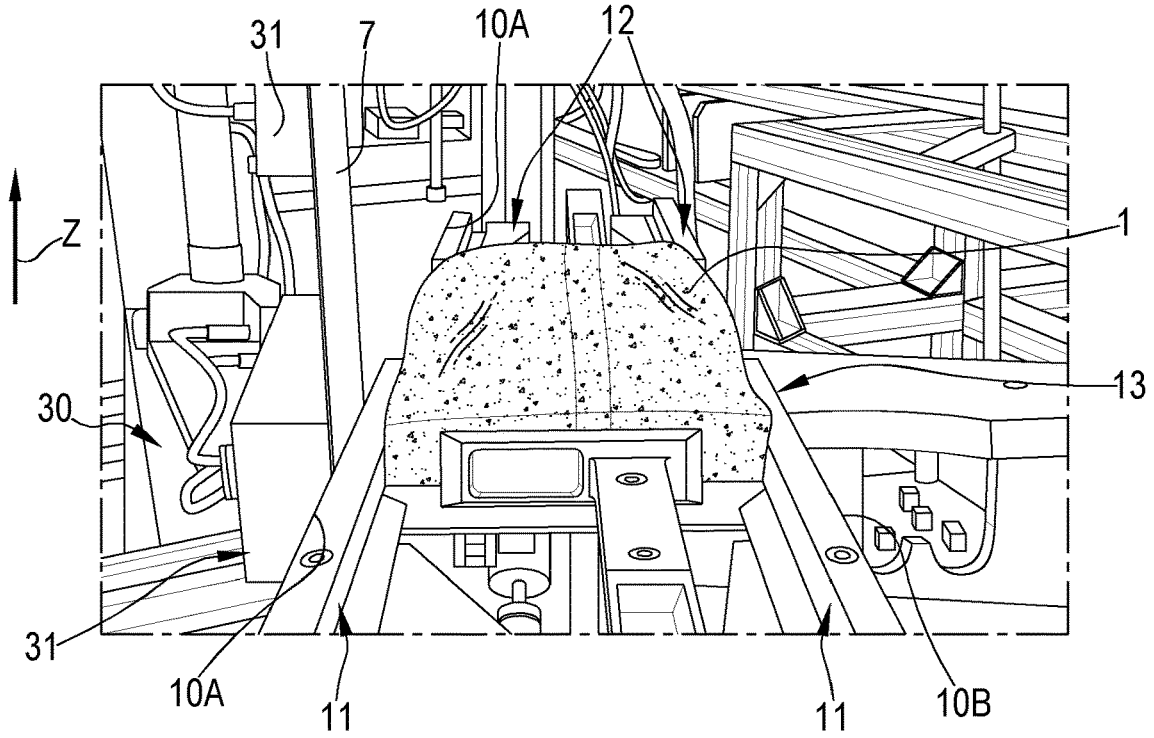
FIGS. 3-5 are partial schematic views of a folding device and of a mandrel of the packaging unit of FIG. 1 and of a blank in three distinct positions of use.
Figure 4:
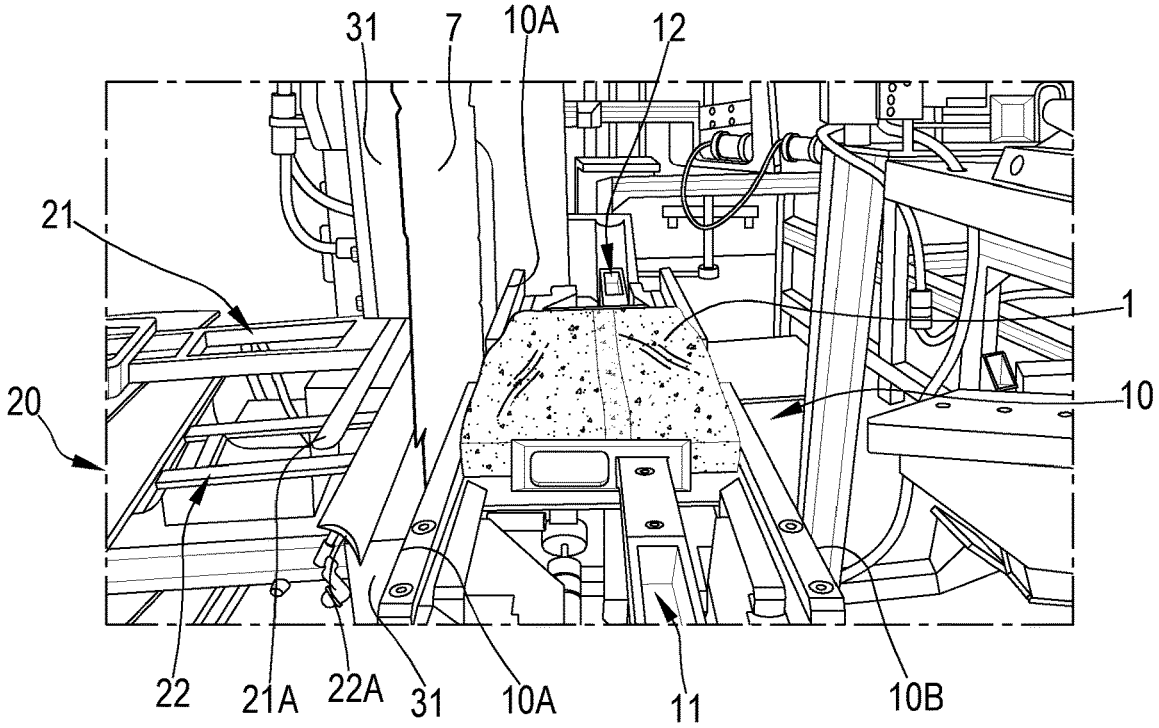
Figure 5:
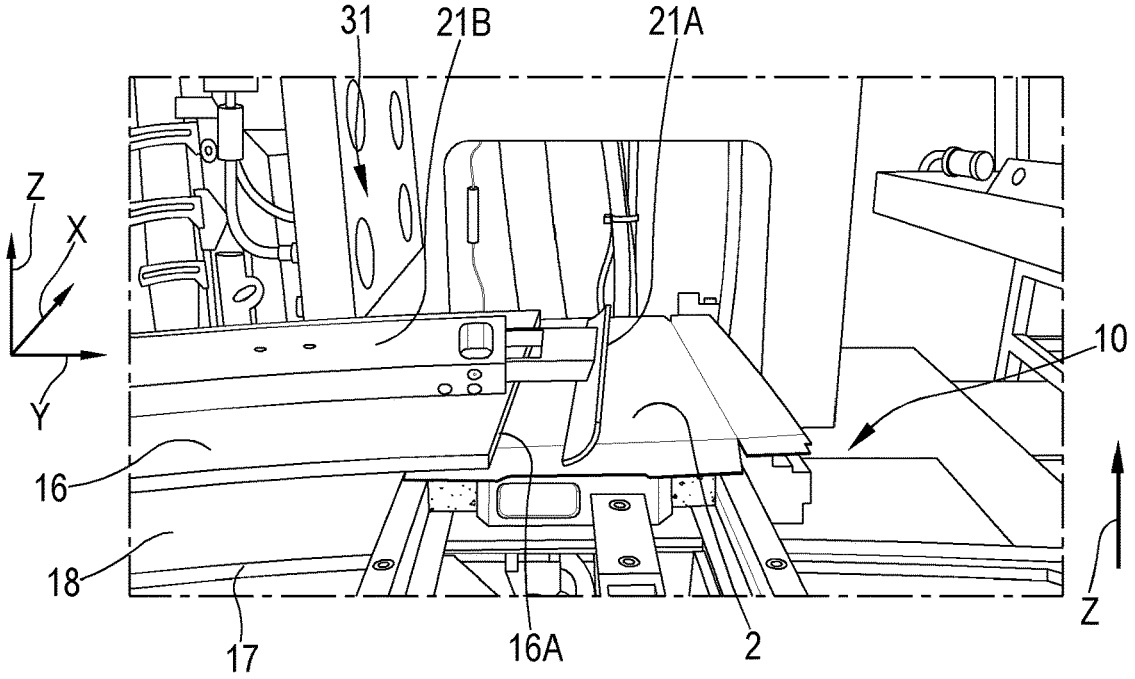
Figure 9:
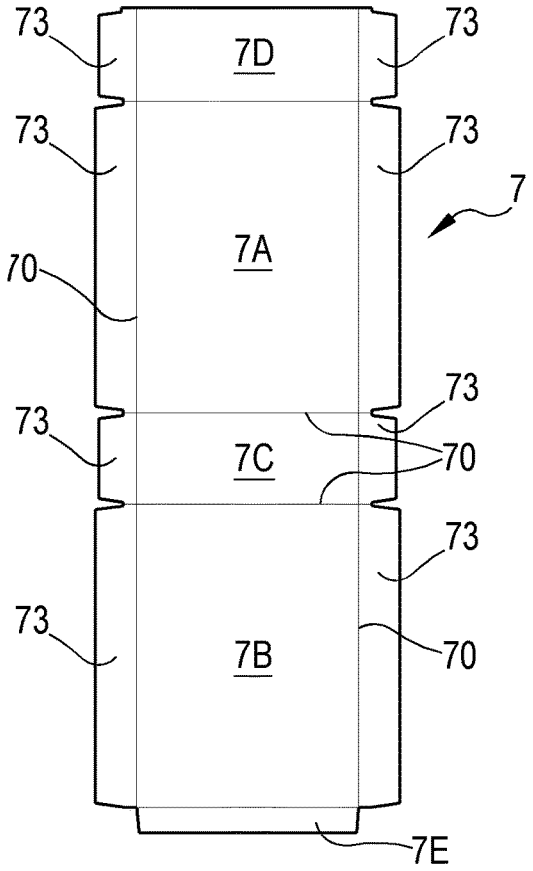
FIG. 9 is a schematic view of a blank usable in the packaging unit of FIG. 1.

The forming carousel 3, the feed carousel 5 and the outlet carousel 6 are brought into rotation, by means of respective movement devices not shown, in order to be rotatable about respective axes of rotation substantially parallel to a vertical direction, indicated in the figures generally with Z perpendicular to the plane of FIGS. 1 and 2.

The forming carousel 3 is provided with a plurality of mandrels 10, each mandrel 10 is configured to accommodate at least one of the articles 1 inside it and is operatively connected to a movement device 50 of the forming carousel 3 to be displaced along a movement trajectory M at a desired movement speed VM, as better explained below. The movement trajectory M lies on an advancement plane 200 of the mandrel 10 and is a line oriented in the shape of an arc of circumference. The movement speed VM is a vector having at each point a direction tangent to the movement trajectory M and a desired modulus M2 which is constant along the movement trajectory M as best schematized in FIG. 10A-10B. The advancement plane of the mandrel 200 has an orientation 200 in an orthogonal Cartesian reference system Z.

The mandrel 10 comprises a first unit 11 and a second unit 12, which are distinct and separated from each other, both mounted on an arm not extended radially by the movement carousel 3 and passing below a fixed work surface 9 of the packaging unit 100, 100'.

The first unit 11 and the second unit 12 are positioned so as to define an accommodation seat 13 for an article 1 to be transported. Advantageously, the first 11 and the second unit 12 are displaceable with respect to each other so as to define an accommodation seat 13 for the articles 1 with variable dimensions.

The mandrel 10 further comprises a first abutment surface 10A defined as the surface of the mandrel 10 intended to be the first to abut the blank 7 when the latter is positioned in the movement trajectory M and a folding surface 10B opposed to the first abutment surface 10A intended to abut the outer flap and the inner flap of the blank when the latter is folded around the mandrel 10, as better explained below. The first abutment surface 10A is the surface of the mandrel 10 provided in the further advanced position along the movement trajectory M. The folding surface 10B is the surface of the mandrel 10 provided in the further backward position along the movement trajectory M.

The feeding carousel 5 comprises a plurality of feeding devices 30, each configured to feed a blank 7 towards a mandrel 10. Each feeding device 30 is configured to pick up a single blank 7 from a group of blanks stacked in a hopper 700 and to bring it to the forming carousel 3 and is configured to feed the blank 7 along a feeding trajectory which intersects the movement trajectory M. Each feeding device 30 comprises a plurality of retaining elements 31 arranged to retain the blank 7 in different portions thereof. Each retaining element 31 comprises a suction cup operatively connected to a suction device, not visible in the figures, and arranged to releasably retain a desired portion of a blank, as better clarified below. An application device 701 is also provided which is intended to apply a desired amount of glue on an edge portion of a flap 7D of the blank 7, when the blank 7 is retained on a retaining device 60 before feeding it to the forming carousel 3.

The blank 7 is made of cardboard with a thickness comprised between 0.4 and 0.8 mm, in this case about 0.5 mm, and is suitably shaped to form a box 2 when folded around the mandrel 10. For this purpose, folding lines 70 are obtained on the blank 7 that divide the blank 7 into a plurality of panels 71 intended to form, alone or in combination with each other, the different faces of the box 2. The folding lines 70 are preferably creases and each pair of adjacent panels 71 is oscillatable around a respective folding line 70 that separates them. In particular, as better visible in FIG. 9, in the blank 7 are identified an intermediate panel 7C, intended to be abutted as first by the mandrel 10, as well as a first and a second panel 7A, 7B that extend respectively on two opposed sides of the intermediate panel 7C and are separated therefrom by respective folding lines 70, and a plurality of flaps 73, 7D, 7E. The first and second panels 7A, 7B are intended to form two opposed faces of the box 2. The first and second panels 7A, 7B are intended to be folded on the mandrel 10 on opposite sides with respect to the advancement plane 200, as better clarified below. The flaps 73, 7D, 7E are separated by an adjacent panel by means of a folding line and are adapted to overlap with other flaps of the plurality of flaps to form the box 2.

In particular, the blank 7 is shaped such that, once wrapped at least partially around the mandrel 10, the two flaps 7D, 7E are overlappable on each other when folded towards each other along the corresponding folding line 70.

The blank 7 is shaped such that, once wrapped at least partially around the mandrel 10, the two flaps 7D, 7E overlap each other abutting the mandrel 10 on a folding surface 10B thereof. The flap 7D, once this overlap has been made, will be located outside the partially closed box; this flap 7D is the so-called outer flap 7D. In a completely similar way, the flap 7E, once such overlap has been made, will be located between the outer flap 7D and the inside of the partially closed box; such flap 7E is the so-called inner flap 7E. The inner flap and the outer flap are shaped so as to overlap each other in an overlapping portion.

Figure 6:
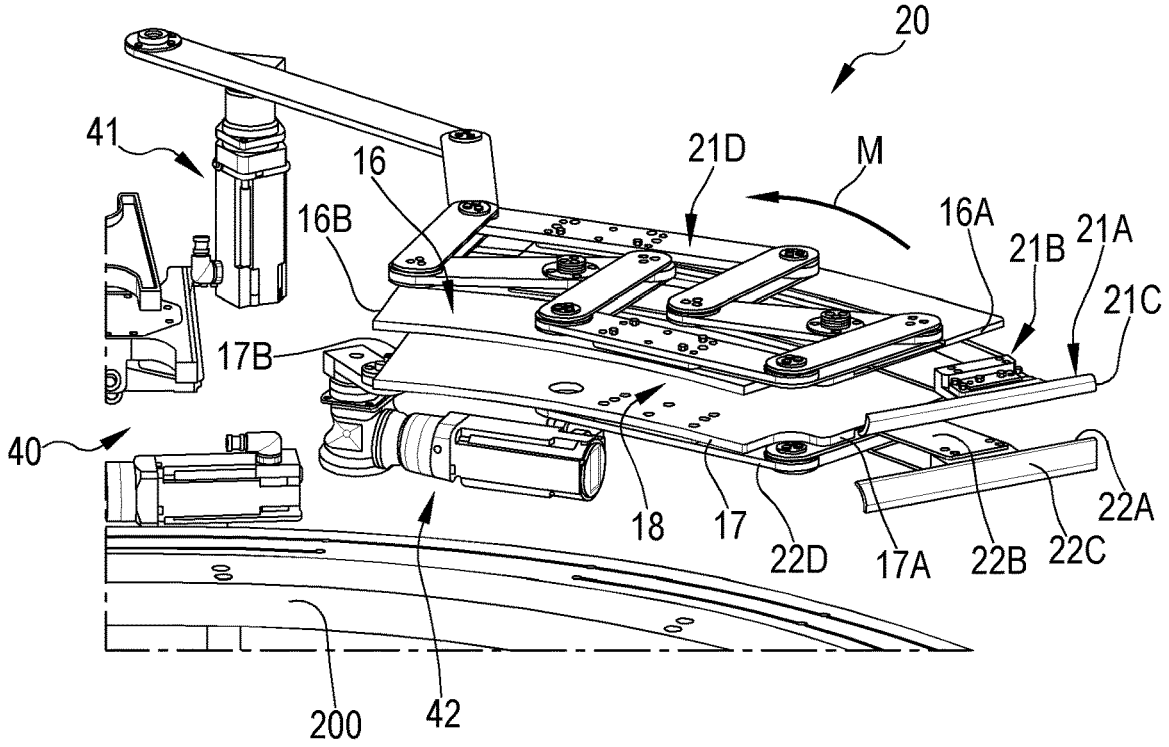
FIGS. 6-7 are partial schematic views of a folding device of the packaging unit of FIG. 1 respectively in a first position and in a second position.
Figure 7:
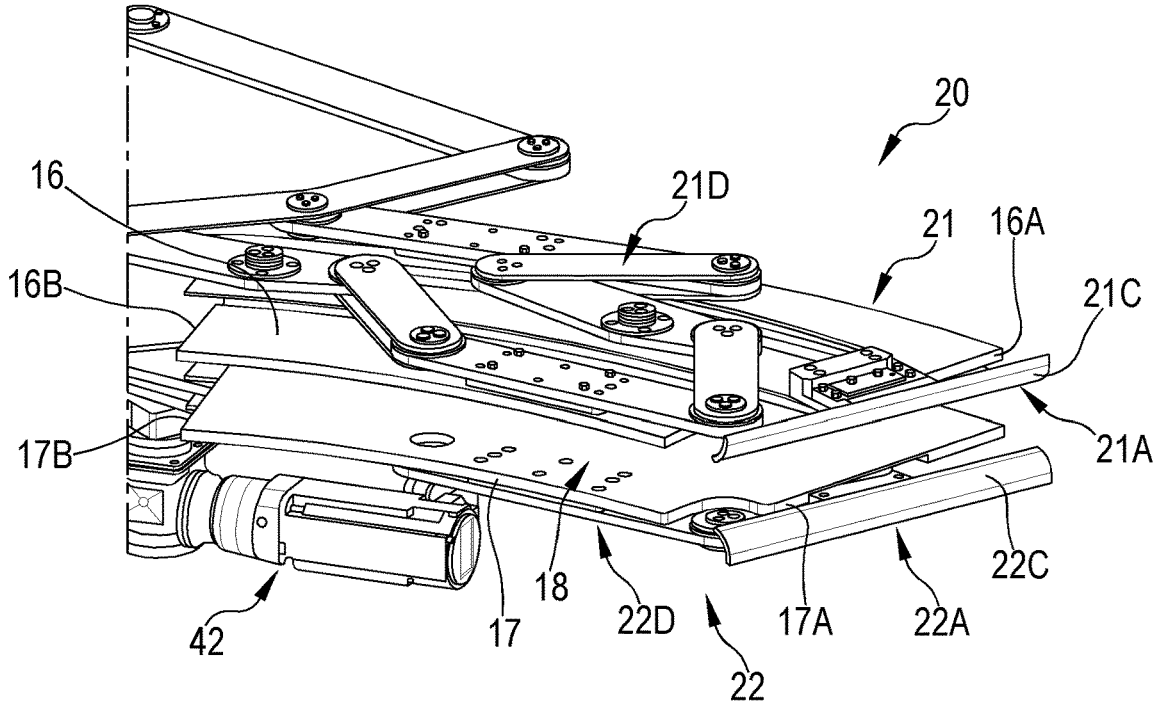

The packaging unit 100, 100' further comprises a folding device 20, better visible in FIGS. 6 and 7, intended to abut the blank 7 and configured to cooperate with the mandrel 10 to fold the blank 7 around the mandrel 10 and an actuation device 40 configured to displace the folding device 20 along at least one folding stroke P which, in the version shown, is defined on the movement trajectory M of the mandrel 10.

The packaging unit 100, 100' further comprises a guide device 15, provided immediately downstream of the folding device 20 and comprising a first guide plate 16 and a second guide plate 17 that are mutually facing and defining a housing 18 for a box to be formed. The first guide plate 16 and the second guide plate 17 extend for a guide stroke G of the movement trajectory M. The first guide plate 16 and the second guide plate 17 extend respectively between a first end 16A, 17A and a second end 16B, 17B, the first end 16A, 17A being provided in a backward position with respect to the second end 16B, 17B and they allow to maintain the shape of the box 2 being formed avoiding unwanted openings thereof. The first end 16A, 17A of the first 16 and second plate 17 define the inlet for the housing 18 through which the mandrel 10 enters the housing 18.

Figure 12:
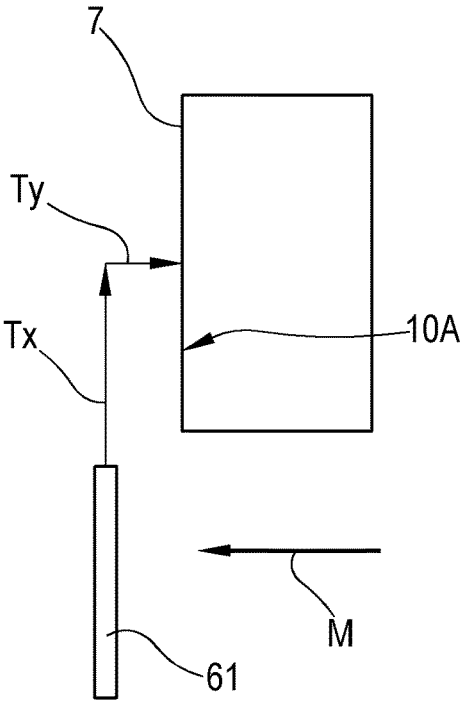
FIG. 12 is a schematic view showing the movement of a retaining element of the packaging unit of FIG. 1.

The packaging unit 100 further comprises a retaining device 60, shown in greater detail in FIGS. 6 and 12, displaceable along an actuation trajectory between an operating position E1, shown in FIG. 6, in which the retaining device 60 is approached to the first abutment surface 10A of the mandrel to retain the blank 7 against the first abutment surface 10A and a non-operating position in which the retaining device 60 is spaced apart from the first abutment surface 10A.

The retaining device 60 comprises a lamina 61 having a retaining surface 62 shaped so as to couple with shape coupling with the first abutment surface 10A. In other words, the retaining device 60 is configured so that the lamina 61 is positioned in an advanced position with respect to the mandrel 10 along the movement trajectory M.

The retaining device 60 is positioned so as to be interposed along the vertical axis Z, in the operating position E1, between the first folding element 21 and the second folding element 22 for retaining the intermediate panel 7C of the blank 7. The lamina 61 is configured to couple to the intermediate panel 7C.

The packaging unit 100 further comprises an actuation member 63 intended to move the retaining device 60 between the operating position E1 and the non-operating position. In the operating position E1 of the retaining device 60 the blank 7 is retained against the first abutment surface 10A of the mandrel 10 while in the non-operating position of the retaining device 60 it is moved away from the blank 7.

Figure 11:
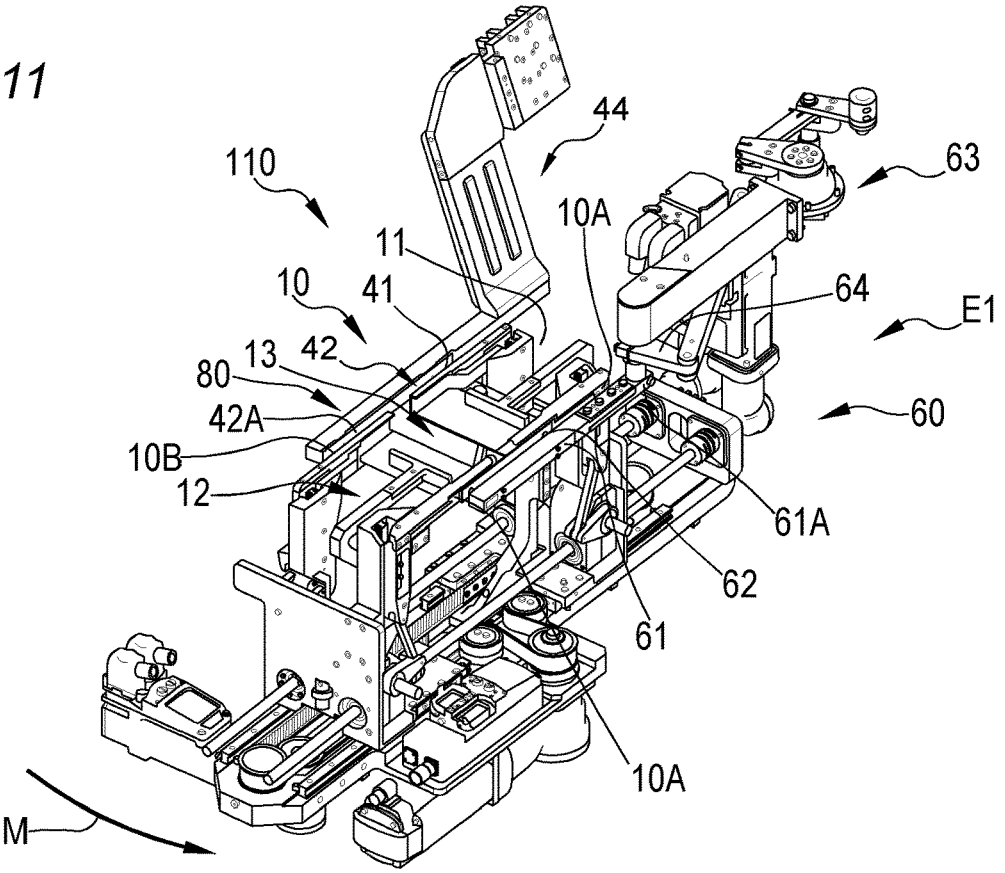
FIG. 11 is a schematic view of a portion of the packaging unit of FIG. 1.

As can be seen from FIG. 11, the retaining device 60 is operatively associated with the mandrel 10 so as to be carried, via the movement device 40, together with the mandrel 10, along the movement trajectory M. The retaining device 60 is also movable with respect to the mandrel 10 in order to be displaced between the operating position E1 and the non-operating position.

In the version shown, the lamina 61 is constrained at a first end 61*a* thereof to a support element 64 interposed between the lamina 61 and the actuation element 63 so as to be displaced between the operating position E1 and the non-operating position along an actuation trajectory having a transverse component Tx transverse to the movement trajectory M and a thrust component Ty parallel to the movement trajectory M. The transverse component Tx and the thrust component Ty are perpendicular to each other and parallel to the advancement plane 200.

In the version shown in FIGS. 1 to 12 the lamina 61 is constrained in a fixed manner to the support element 64, while in the version shown in FIGS. 13-15 the lamina 61' is constrained in an adjustable manner to the support element 64', as better clarified below.

With reference to FIGS. 13-15 the retaining device 60' comprises a lamina 61' with a retaining surface 61A' with a shape analogous to the first abutment surface 10A of the mandrel 10 and hooked by an adjustment device 65' in an adjustable manner to the support structure 64'. In this way the lamina 61' is displaceable with respect to the support structure 64' along a direction transversal to the first abutment surface 10A of the mandrel.

The adjustment device 65' comprises a pair of adjustment elements 65' spaced apart along a longitudinal direction of the lamina 61'. Each adjustment element 65' comprises a pin 66' extended between the lamina 61' and the support structure 64 to hook the lamina 61' and the support structure 64' and a spring 67' hooked at a first end thereof to the support structure 64' and at an opposed end thereof to the pin 66' and deformable to allow the displacement of the lamina 61' with respect to the support structure 64'.

Other adjustment elements can be used in other versions.

The packaging unit 100, 100' further comprises a closing device 80 to fold two flaps of the blank onto the mandrel 10. As can be seen from FIG. 11, the closing device 80 is operatively associated with the mandrel 10 so as to be carried, via the movement device 50, together with the mandrel 10, along the movement trajectory M. The closing device 80 is also movable with respect to the mandrel 10 in order to be displaced between the operating position E1 and the non-operating position.

The closing device 80 comprises a displacement member, not visible in the figures, and an abutting element 41 movable with respect to the mandrel 10 between a rest position in which the abutting element 41 is remote with respect to the mandrel 10 and a pressure position, in which the abutting element 41 is in a position such as to press the outer flap 7D on the inner flap 7E and against a folding surface 10B of the mandrel 10. The displacement member moves the abutting element 41 between the rest, folding and pressure positions.

Said displacement member comprises an articulated arm that actuates the displacement of the abutment element 41 between the rest and pressure positions.

The abutment element 41 comprises a support element 44 constrained to the displacement member, two compensating elements not shown in the Figures, and a pressure plate 42 having a pressure surface 42A intended to abut the mandrel 10 in its folding surface 10B.

The abutting element 41, in passing from the rest position to the folding position and then to the pressure position, approaches the mandrel 10 from the side of the outer 7D and inner 7E flaps of the blank 20 until it meets the outer flap 7D and pushes it against the mandrel 10 until it abuts the mandrel 10 itself on its folding surface 10B together with the inner flap 7D.

The approach of the abutment element 41 to the mandrel 10 from the rest position to the pressure position takes place with a straight trajectory D that is inclined with respect to the folding surface 10B of the mandrel 10. Advantageously, the folding trajectory D is inclined with respect to the advancement plane of the mandrel 10.

As soon as the abutment element 41, and in particular the pressure plate 42 with its pressure surface 42A, contacts the mandrel 10 on its folding surface 10B, by pressing the outer flap 7D on the inner flap 7E and against the folding surface 10B, the compensating elements orient the abutment element 41 so that the pressure surface 42A and the folding surface 10B abut so as to be parallel.

In this way in the pressure position any misalignments between the folding surface 10B of the mandrel 10 and the abutment element 41 are corrected.

In the version shown the packaging unit 100, 100' comprises a plurality of mandrels 10, a plurality of retaining devices 60, a plurality of closing devices 80 movable along the movement trajectory M.

In the version shown, a plurality of equipment 110 movable along the movement trajectory M can be identified in the forming carousel 3, each equipment 110 comprising a mandrel 10, a retaining device 60 and a closing device 80. In this way the mandrel 10, the retaining device 60 and the closing device 80 of the same equipment 110 are displaced together along the movement trajectory M, and furthermore the retaining device 60 and the closing device 80 can be moved with respect to the mandrel 10 to retain and fold the blank 7. The equipment 110 of the plurality of equipment are carried by the movement device so as to interact in succession with various devices provided in the packaging unit to form a box around a mandrel.

Each mandrel 10 is carried along the movement trajectory M between a receiving zone 202, in which the mandrel 10 receives an article 1 from the transfer carousel 103, an abutment zone 203, in which the mandrel 10 abuts a blank 7 supplied by the feeding device 30 in a first abutment position R1, a forming zone 204, in which the blank 7 is folded on the mandrel so as to form a box 2 containing the article 1, an unloading zone 205, in which the box 2 containing the article 1 is deposited on the outlet carousel 6 and, finally, a return zone 206 in which the mandrel 10 is returned to the receiving zone 202. From the outlet carousel 6, the box 2 is then deposited on the evacuation belt 8 to be transported to the subsequent processing stations.

The folding device 20, better visible in FIGS. 6 and 7, comprises a first folding element 21 and a second folding element 22 which are arranged to abut respectively the first panel 7A and the second panel 7B of the blank 7. The first and second folding elements 21, 22 are positioned so as to respectively abut a first 7A and a second panel 7B of the blank 7 which are positioned on opposite sides of the blank 7 with respect to the advancement plane 200 defined by the mandrel 10.

Each folding element 21, 22 comprises a folding portion 21A, 22A shaped to interact with the blank 7, and a first and a second movement member 21D, 22D for transmitting the motion from a respective actuation motor 42 respectively to the first and the second folding element 21, 22. The first and the second movement member 21D, 22D comprise a plurality of mutually hinged levers to form an articulated polygon movement member.

The first 21 and the second folding element 22 are associated respectively with the first 16 and the second guide plate 17. This measure increases the stability of the folding device 20 and optimises the folding of the box avoiding unwanted openings.

Each folding portion 21A, 22A defines a respective first impact surface 21C, 22C of the blank 7 against the respective folding element 21, 22. The first impact surface 21C, 22C is the surface of each folding element 21, 22 which abuts the blank 7 as first when positioned on the movement trajectory M.

The first impact surface 21C, 22C has a rounded shape, convex towards the blank 7 with a curvature such as to form with the blank an angle of about 45° and is made of low friction coefficient material, usually plastic or metallic material. The first impact surface 21C, 22C is made of stainless steel.

The actuation device 40 is configured to move the folding device 20 alternately in a direction concordant to the movement trajectory M and in a direction opposite to the movement trajectory M.

Figure 10A:
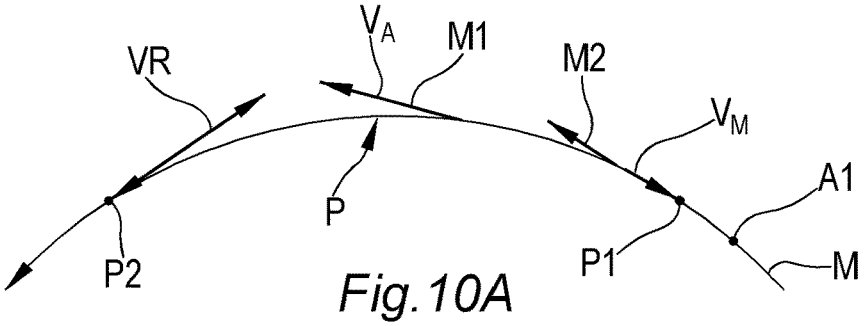
FIGS. 10A and 10B are two interrupted graphs of a movement trajectory of the packaging unit of FIG. 1.
Figure 10B:
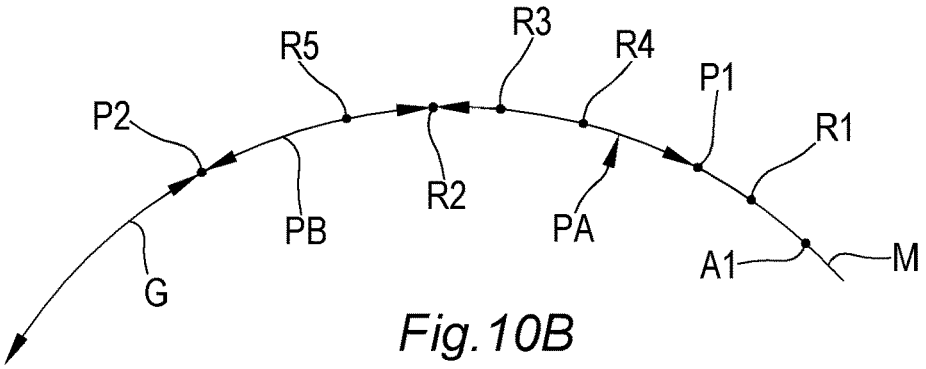
Figure 8:
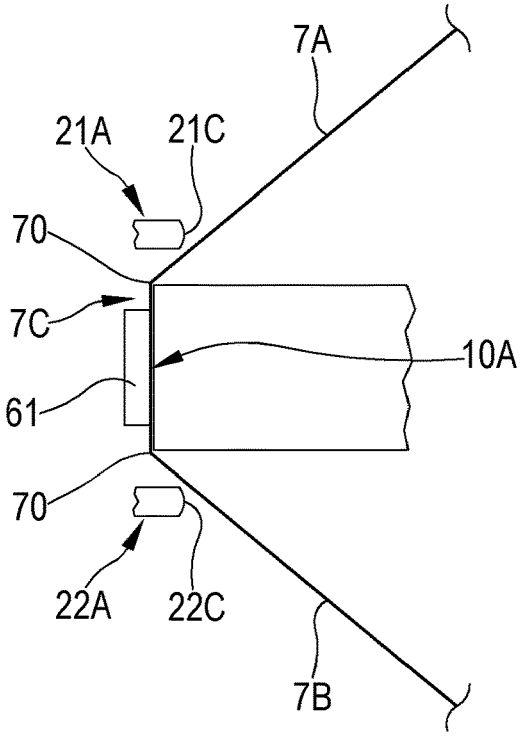
FIG. 8 is a schematic figure of a folding device and of a mandrel of the packaging unit of FIG. 1 and of a blank in a position of use.

In particular, as better schematized in FIGS. 10A and 10B, the folding device 20 is moved along the folding stroke P in a direction concordant to the movement trajectory M with an accompanying speed Va to fold the blank 7 on the mandrel 10 and along the folding stroke P in a direction contrary to the movement trajectory M with a return speed VR so as to be brought towards the mandrel 10.

The folding device 20 is movable along the folding stroke P between a first position P1 which corresponds to the further backward position of the folding device 20 along the movement trajectory M and a second position P2 which corresponds to the most advanced position of the folding device 20 along the movement trajectory M. The second position P2 is provided respectively near the first end 16A, 17A of the first 16 and the second plate 17.

The actuation device 40 moves the folding device 20 from the second position P2 to the first position P1 with a return speed VR to bring it towards the mandrel 10 and moves the folding device 20 from the second position P2 to the first position P1 with an accompanying speed concordant to the movement speed VM to fold the blank 7.

In particular, the actuation device 40 moves the folding device 20 in succession along a first portion PA of the folding stroke P between the first position P1 and an abutment position R2 and along a second portion PB of the folding stroke P between the abutment position R2 and the second position P2. In the first portion PA the folding device 20 is spaced apart from the mandrel 10 and from the blank 7, while in the second portion PB the folding device 20 is in contact with the blank 7.

In the first portion PA, the distance between the folding device 20 and the mandrel 10 is progressively reduced up to the abutment position R2 in which the folding device 20 abuts the blank 7. The abutment position R2 is provided downstream of the first abutment position R1. In the second portion of the folding stroke PB the folding device is at least overlapped on the mandrel 10.

In the first position P1, which is provided downstream of the first abutment position R1, the folding device 20 is spaced apart from the mandrel 10 and from the blank 7 and positioned at an advanced position with respect to the mandrel 10. In the second position P2 the folding device is overlapped on the mandrel 10.

The operation of the packaging unit 100, 100' is now explained. An article 1 is deposited on a mandrel 10 at the receiving zone 202 and moved together with the mandrel 10 along the movement trajectory M. The mandrel 10 is moved along the movement trajectory M at a movement speed VM having modulus M2.

The feeding device 30 feeds a blank 7 towards the movement carousel 3, positioning it in a feeding position A1 provided along the movement trajectory M in an advanced position with respect to the mandrel 10 and moves the blank 7 for a stroke of the movement trajectory M.

The mandrel 10 in movement along the trajectory M approaches the blank 7 until, in the first abutment position R1, the first abutment surface 10A of the mandrel 10 abuts the blank 7. Subsequently, the mandrel 10 moves along the feeding stroke A2 together with the blank 7 and the feeding device 30 up to a retaining position R4 in which the retaining device 60, 60' is positioned in the operating position E1 and engages the intermediate panel 7C of the blank 7 to retain it on the mandrel 10. In the retaining position R4 the lamina 61, 61' of the retaining device 60, 60' presses the blank against the first impact surface 10A of the mandrel 10. Since the retaining device 60, 60' is mounted integrally to the mandrel 10, the retaining device 60, 60' is dragged together with the mandrel 10 along the movement trajectory M continuing to retain the blank against the mandrel 10 itself.

The operating member 63, 63' displaces the retaining device 60 towards the blank 7 to bring it against the intermediate panel 7C of the blank 7, as schematized in FIG. 12. The presence of the retaining device 60, 60' makes it possible to make the positioning of the blank on the mandrel 10 more precise so as to fold the blank around the mandrel in an extremely precise manner. In addition, if the adjustment device is provided, this retention is very precise even in the case of misalignments.

From the retaining position R4 the mandrel 10 continues to transport the blank 7 along the movement trajectory M up to a release position R3 in which the feeding device 30 releases the blank 7. From the release position R3 the mandrel 10 transports the blank 7 up to the abutment position R2 where the folding device 20 abuts the blank 7. The presence of the retaining device 60, 60' allows the blank 7 to be released from the retaining device 60, 60' upstream of the abutment position R2.

From the abutment position R2 to the second position P2 the mandrel and the folding device both move along the movement trajectory M folding the blank 7 around the mandrel 10. In the second position P2 the folding device 20 stops while the mandrel 10 continues its movement along the movement trajectory M coming out of the folding device 20 to enter the housing 18 defined between the first guide plate 16 and the second guide plate 17.

In the abutment position R2 the folding device 20 is moving along the folding stroke P at the accompanying speed Va which is parallel to the movement speed VM and has modulus M1 lower than the modulus M2 of the movement speed VM. It is noted that when the folding device 20 abuts the blank 7, the folding device 20 is moved in a manner concordant to the mandrel 10 even if at a speed with a lower modulus and this prevents there being kickbacks on the blank 7 and sudden strokes being imparted on the same.

Since the accompanying speed Va of the folding device 20 has a modulus M1 lower than the further modulus M2 of the movement speed VM, in the second portion PB of the folding stroke P a relative motion between the folding device 20 and the mandrel 10 and, therefore, between the folding device 20 and the blank 7 is generated since the latter is integral with the mandrel 10.

In other words, since in the second folding stroke PB the folding device 20 is slower than the mandrel 10 it progressively slides along the blank 7 in the direction opposed to the movement trajectory M, effectively folding the blank 7 around the mandrel 10. The folding device 20 abuts the blank 7 in the abutment position R2 and accompanies the mandrel up to the second position P2, that is up to the inlet of the housing 18 progressively folding the blank 7 on the mandrel 10.

Between the abutment position R2 and the second position P2 a detachment position R5 can be provided in which the retaining device 60 moves away from the mandrel 10 and then from the blank 7 returning to the non-operating position. Since said detachment position R5 is provided downstream of the abutment position R2, when the retaining device 60 detaches itself from the blank 7, the latter is retained on the mandrel 10 in addition to the friction force generated by the movement of the mandrel 10 itself, also by the folding device 20 which has already engaged the blank 7 and which exerts a thrust force on the blank 7 to fold it on the mandrel 10. The blank 7 is therefore interposed between the mandrel 10 and the folding device 20. Thus, the blank 7 does not displace itself from the desired position.

Conveniently, by acting on the actuation element 63, 63', it is possible to vary the duration of the retention, i.e. the distance between the retention position R4 and the detachment position R5, based, for example, on the characteristics of the blank 7. In one embodiment, the retaining device 60 is held in the operating position E1 until the end of the step of forming the box 2.

A very precise folding of the box 2 around the mandrel 10 is obtained.

The invention claimed is:

1. A packaging unit for packaging articles in boxes, comprising:

a mandrel configured to accommodate at least one of said articles therein, a movement device configured to move said mandrel along a movement trajectory, a feeding device configured to feed at least one blank along a feeding trajectory towards said mandrel to form one of said boxes around said mandrel, a first abutment surface of said mandrel to abut said blank when positioned in said movement trajectory, and a retaining device displaceable between an operating position and a non-operating position, wherein:

the feeding trajectory intersects said movement trajectory, in the operating position said retaining device approaches said first abutment surface to retain said blank against said first abutment surface, and in the non-operating position said retaining device is spaced apart from said first abutment surface, the packaging unit further comprising:

an actuation member configured to displace said retaining device along an actuation trajectory to bring said retaining device towards said operating position, wherein said actuation trajectory comprises a transverse stroke arranged transversely to the movement trajectory of said mandrel, and a thrust stroke arranged parallel to the movement trajectory of said mandrel.

2. The packaging unit according to claim 1, wherein:

an advancement plane is defined by said mandrel when moved along said movement trajectory, and said movement device is configured to move said mandrel along the advancement plane and said transverse stroke is parallel to said advancement plane.

3. The packaging unit according to claim 1, wherein:

an advancement plane is defined by said mandrel when moved along said movement trajectory, and said movement device is configured to move said mandrel along the advancement plane and said transverse stroke is perpendicular to said advancement plane.

4. The packaging unit according to claim 1, wherein:

said actuation member is configured to displace said retaining device along said thrust stroke in a direction that is opposite with respect to the movement trajectory of said mandrel to displace said retaining device into said operating position.

5. The packaging unit according to claim 1, wherein said movement device is configured to move said mandrel along a movement trajectory comprising a portion of circular trajectory.

6. The packaging unit according to claim 1, wherein said actuation trajectory comprises a further transverse stroke arranged radially with respect to the movement trajectory of said mandrel.

7. The packaging unit according to claim 6, wherein said feeding device is configured to move said blank along a feeding trajectory comprising at least one radial feeding stroke arranged radially with respect to the movement trajectory of said mandrel.

8. The packaging unit according to claim 7, each said at least one radial feeding stroke having a direction opposed to said further transverse stroke.

9. The packaging unit according to claim 1, wherein said retaining device is operatively associated with said movement device to carry said retaining device along said movement trajectory.

10. The packaging unit according to claim 1, further comprising a folding device to abut said blank and configured to cooperate with said mandrel to fold said blank around said mandrel when said blank is positioned between said mandrel and said folding device.

11. The packaging unit according to claim 10, said folding device comprising:

a first folding element and a second folding element arranged to respectively abut a first panel and a second panel of said blank, wherein said retaining device is interposed in said operating position between said first folding element and said second folding element for retaining an intermediate panel of said blank interposed between said first panel and said second panel.

12. The packaging unit according to claim 11, wherein said retaining device is configured to couple to said intermediate panel.

13. A method for packaging articles in boxes comprising:

a) depositing at least one of said articles in a mandrel, b) moving said mandrel along a movement trajectory, c) displacing at least one blank by a feeding device and positioning said blank along said movement trajectory of said mandrel in an advanced position with respect to said mandrel, d) abutting said first blank with a first abutment surface of said mandrel, e) retaining said blank against said first abutment surface with a retaining device, f) decoupling said blank from said feeding device, g) displacing said blank and said mandrel along said movement trajectory while said blank is retained against said first abutment surface, and h) displacing said retaining device between an operating position in which said retaining device retains said blank against said first abutment surface of said mandrel and a non-operating position in which said retaining device is spaced apart from said first abutment surface, wherein said step h) of displacing said retaining device comprises displacing said retaining device along a transverse stroke arranged transversely to the movement trajectory of said mandrel, and displacing said retaining device along a thrust stroke arranged parallel to the movement trajectory of said mandrel.

14. The method according to claim 13, wherein said step e) retaining said blank against said first abutment surface occurs prior to said step f) decoupling said blank from said feeding device.

15. The method according to claim 13, wherein said step e) retaining said blank against said first abutment surface occurs after said step d) abutting said blank with said first abutment surface of said mandrel.

16. The method according to claim 13, further comprising:

providing a folding device configured to cooperate with said mandrel to fold said blank around said mandrel when said blank is positioned between said mandrel and said folding device, and abutting said blank with said folding device to fold said blank around said mandrel.

17. The method according to claim 16, wherein said step e) retaining is provided prior to said step of abutting said blank with said folding device, and wherein said step f) decoupling is provided after said step of abutting said blank with said folding device.

* * * * *